US008002086B2

(12) United States Patent
Ito

(10) Patent No.: US 8,002,086 B2
(45) Date of Patent: Aug. 23, 2011

(54) MAGNETIC GUIDE APPARATUS

(75) Inventor: Hiroaki Ito, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 534 days.

(21) Appl. No.: 12/200,114

(22) Filed: Aug. 28, 2008

(65) Prior Publication Data

US 2009/0065309 A1 Mar. 12, 2009

(30) Foreign Application Priority Data

Sep. 11, 2007 (JP) ..... 2007-235532

(51) Int. Cl.
*B66B 1/34* (2006.01)

(52) U.S. Cl. ..... 187/292; 187/409; 187/393

(58) Field of Classification Search ..... 187/277, 187/289, 292, 293, 296, 297, 391–393, 401, 187/409, 410; 318/799–815, 600, 609, 610, 318/611, 623

See application file for complete search history.

(56) References Cited

U.S. PATENT DOCUMENTS

| | | | | |
|---|---|---|---|---|
| 5,652,414 | A * | 7/1997 | Roberts et al. | 187/292 |
| 5,749,444 | A * | 5/1998 | Skalski | 187/409 |
| 5,814,774 | A * | 9/1998 | Remmers et al. | 187/292 |
| 5,866,861 | A * | 2/1999 | Rajamani et al. | 187/292 |
| 5,955,709 | A * | 9/1999 | Traktovenko et al. | 187/292 |
| 6,338,396 | B1 * | 1/2002 | Morishita | 187/292 |
| 6,401,872 | B1 * | 6/2002 | Morishita | 187/292 |
| 6,408,987 | B2 * | 6/2002 | Morishita | 187/292 |
| 7,793,760 | B2 * | 9/2010 | Ito et al. | 187/292 |
| 7,841,451 | B2 * | 11/2010 | Ito | 187/292 |

FOREIGN PATENT DOCUMENTS

| | | | |
|---|---|---|---|
| CN | 101 475 113 | A | 7/2009 |
| JP | 5-178563 | A | 7/1993 |
| JP | 11-71067 | A | 3/1999 |
| JP | 2001-19286 | A | 1/2001 |
| JP | 2005-350267 | A | 12/2005 |

OTHER PUBLICATIONS

U.S. Appl. No. 12/347,037, filed Dec. 31, 2008, Ito.

* cited by examiner

*Primary Examiner* — Jonathan Salata
(74) *Attorney, Agent, or Firm* — Foley & Lardner LLP

(57) ABSTRACT

A magnetic guide apparatus includes at least two gap sensors which are disposed with a predetermined interval in a direction of movement of a moving body, and detect a gap between a magnet unit and a guide rail, a signal correction unit which determines variation amounts of detection signals which are output from the gap sensors, relatively varies weight coefficients for the respective detection signals on the basis of the variation amounts, and outputs, as a signal for magnetic control, a signal which is obtained by adding the detection signals which are multiplied by the weight coefficients, and a control unit which controls the magnetic force of the magnet unit on the basis of the signal for magnetic control, which is output from the signal correction unit.

13 Claims, 31 Drawing Sheets

MAGNETIC GUIDE APPARATUS

CROSS-REFERENCE TO RELATED APPLICATIONS

This application is based upon and claims the benefit of priority from prior Japanese Patent Application No. 2007-235532, filed Sep. 11, 2007, the entire contents of which are incorporated herein by reference.

BACKGROUND OF THE INVENTION

1. Field of the Invention

The present invention relates to a magnetic guide apparatus for non-contactly guiding the running of, for example, a car of an elevator along guide rails.

2. Description of the Related Art

In general, a car of an elevator is supported on a pair of guide rails which are vertically disposed in the elevation path, and the car is elevated by ropes which are wounded around a hoister. At this time, shaking of the car, which occurs due to imbalance of the load weight or movement of passengers, is suppressed by the guide rails.

In usual cases, a contact-type guide apparatus is used as a guide apparatus for guiding the car in the direction of elevation. Specifically, use is made of roller guides comprising wheels, which are in contact with the guide rails, and suspensions, or guide shoes which slide over the guide rails and guide the car.

In this contact-type guide apparatus, however, vibration or noise occurs due to deformation of guide rails or joints of the guide rails. In addition, noise occurs when the roller guides rotate. Thus, there occurs a problem that the comfortablility of the elevator deteriorates.

In order to solve this problem, there has conventionally been proposed a method of non-contactly guiding the car in the direction of elevation, for example, as disclosed in Jpn. Pat. Appln. KOKAI Publication No. H5-178563 or Jpn. Pat. Appln. KOKAI Publication No. 2001-19286.

In the method of KOKAI H5-178563, a guide apparatus comprising electromagnets is used. The guide apparatus is mounted on the car, and magnetic force is caused to act on iron-made guide rails, thereby non-contactly guiding the car. Specifically, electromagnets, which are disposed at four corners of the car, surround the guide rails from three directions, and the magnetization of each electromagnet is controlled in accordance with the size of the gap between the guide rail and the guide apparatus, thereby non-contactly guiding the car along the guide rails.

The above-described KOKAI 2001-19286 discloses the use of permanent magnets in order to solve problems, such as a decrease in controllability and an increase in power consumption, which occur in the guide apparatus using the electromagnets. By using permanent magnets and electromagnets in combination, the car can be supported with a low rigidity/long stroke, with power consumption being suppressed.

In usual cases, the non-contact-type guide apparatus using magnetic force is provided with gap sensors for detecting the gap between the electromagnet and the guide rail. The magnetic force is controlled in accordance with the gap that is detected by the gap sensors, and the car is supported without contact with the guide rail.

However, in general, the guide rail is disposed in such a manner that a plurality of rails each having a predetermined length are vertically connected. Accordingly, joints are present along the whole guide rail at intervals. At the parts of the joints, there are stepped portions due to the non-uniformity of the shapes of rails and the non-uniformity of the precision in disposition of rails, and the detection signal of the gap sensor is greatly disturbed instantaneously.

In addition, it the case of using a gap sensor utilizing physical properties of an object of detection, such as an eddy-current-type sensor, the detection signal at the part of the joint of the rails is disturbed more than a degree of actual variation.

As described above, if the detection signal of the gap sensor is disturbed, the control of magnetic force is also disturbed. As a result, the car is shaken, and such a problem arises that the comfortability in riding is affected.

Jpn. Pat. Appln. KOKAI Publication No. H11-71067, for instance, discloses an invention for solving the above-described problem. In KOKAI H11-71067, there is proposed a method in which a plurality of gap sensors are provided, and sensor signals which are used are properly switched on the basis of the variation of signals of the sensors.

However, in the method of switching a plurality of sensor signals, as in KOKAI H11-71067, an input sensor signal for control becomes discontinuous, and as a result, the control of magnetic force becomes unstable. In addition, in the case where there is discontinuity between the plural sensor signals, the discontinuity is detected as a signal vibration at the time of switching, and as a result, the control becomes unstable.

There are also known a method in which an upper limit is set to the variation ratio of the sensor signal, and a method in which the variation of each sensor signal is suppressed by a low-pass filter. However, when the car is actually greatly shaken by external disturbance, this movement cannot exactly be detected and the non-contact state cannot be maintained. Besides, if the phase of the sensor signal is displaced, the stability of the control system deteriorates and thus a filter with a large-delay element cannot be used.

BRIEF SUMMARY OF THE INVENTION

According to an aspect of the present invention, there is provided a magnetic guide apparatus comprising: a guide rail formed of a ferromagnetic body; a moving body which moves along the guide rail; a magnet unit which is disposed on a part of the moving body, which is opposed to the guide rail, and supports, by an action of magnetic force, the moving body in a state in which the moving body is out of contact with the guide rail; at least two gap sensors which are disposed with a predetermined interval in a direction of movement of the moving body, and detect a gap between the magnet unit and the guide rail; a signal correction unit which determines variation amounts of detection signals which are output from the gap sensors, relatively varies weight coefficients for the respective detection signals on the basis of the variation amounts, and outputs, as a signal for magnetic control, a signal which is obtained by adding the detection signals which are multiplied by the weight coefficients; and a control unit which controls the magnetic force of the magnet unit on the basis of the signal for magnetic control, which is output from the signal correction unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

First Embodiment

Figure 1:
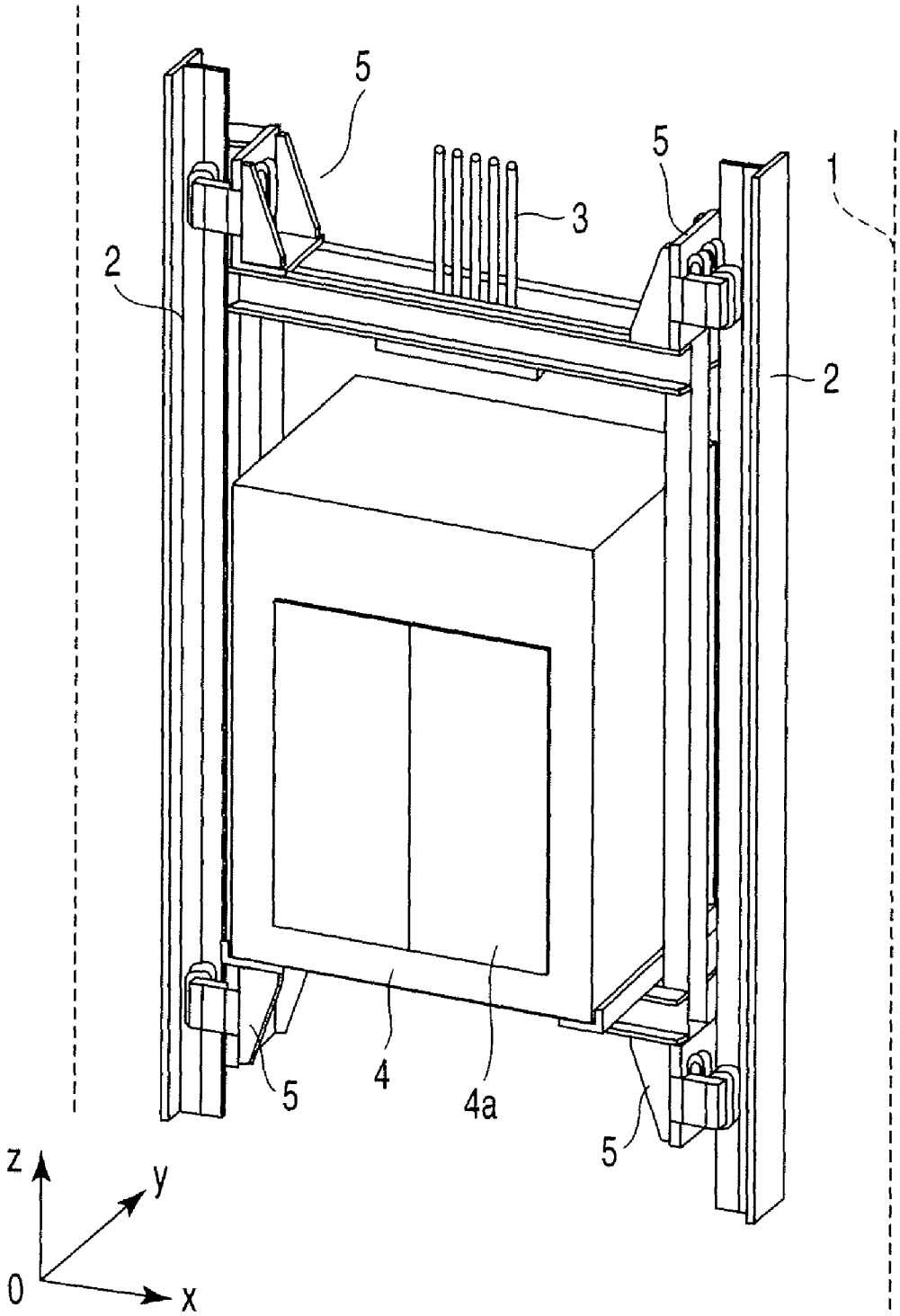
FIG. 1 is a perspective view in a case where a magnetic guide apparatus according to a first embodiment of the present invention is applied to a car of an elevator.

FIG. 1 is a perspective view in a case where a magnetic guide apparatus according to a first embodiment of the present invention is applied to a car of an elevator.

As is shown in FIG. 1, a pair of guide rails 2, which are formed of iron-made ferromagnetic bodies, are erectingly provided in an elevation path 1 of the elevator. A car 4 is suspended by ropes 3 which are wound around a hoister (not shown). With the rotation of the hoister, the car 4 is elevated along the guide rails 2. Reference numeral 4*a* denotes a car door. The car door 4*a* is opened/closed when the car 4 arrives at each floor.

It is assumed that when the car door 4*a* of the car 4 is viewed in the frontal direction, the right-and-left direction of the car door 4*a* is an x axis, the back-and-forth direction is a y axis, and the up-and-down direction is a z axis.

Magnetic guide apparatuses 5 are attached to coupling parts at four corners of the car 4, namely, upward, downward, leftward and rightward corners of the car 4, in a manner to face the guide rails 2. As will be described later, by controlling the magnetic force of the magnetic guide apparatuses 5, the car 4 levitates from the guide rails 2 and runs non-contactly.

Figure 2:
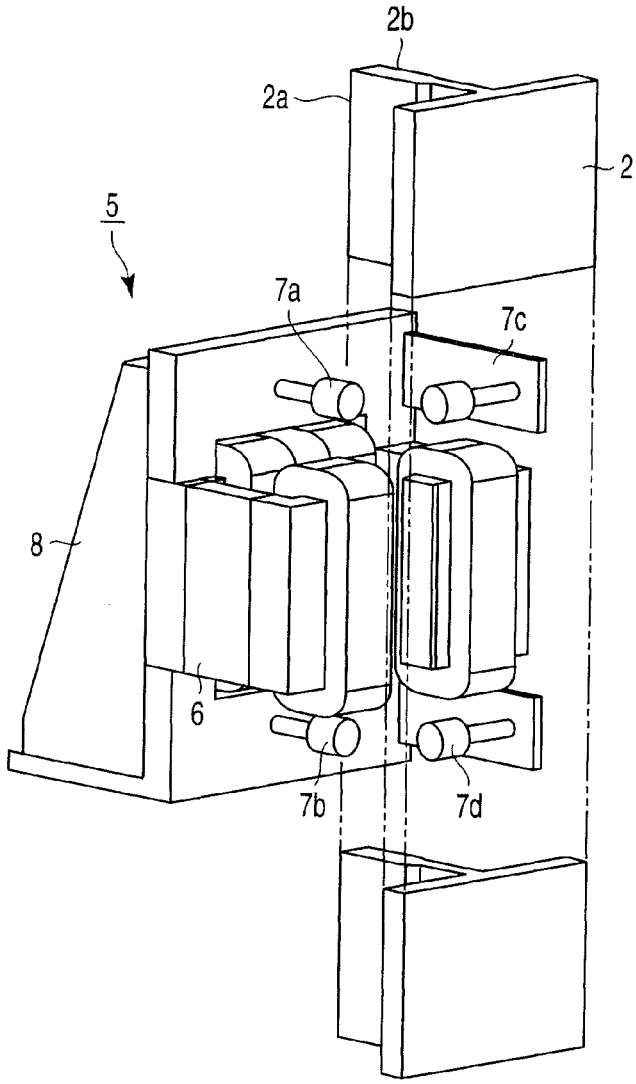
FIG. 2 is a perspective view showing the structure of the magnetic guide apparatus according to the first embodiment.

FIG. 2 is a perspective view showing the structure of the magnetic guide apparatus 5.

The magnetic guide apparatus 5 comprises a magnet unit 6, gap sensors 7*a* to 7*d* which detect the distance between the magnet unit 6 and the guide rail 2, and a base 8 which supports the magnet unit 6 and gap sensors 7*a* to 7*d*. As shown in FIG. 1, the magnetic guide apparatuses 5 are attached to coupling parts at four corners of the car 4, namely, upward, downward, leftward and rightward corners of the car 4, and have the same structure.

Of the gap sensors 7*a* to 7*d*, the sensors 7*a* and 7*b* are opposed to an inside surface 2*a* of the guide rail 2 having a T-shaped cross section. The sensors 7*a* and 7*b* are disposed with a predetermined distance in the longitudinal direction of the guide rail 2. The sensors 7*c* and 7*d* are opposed to a lateral side surface 2*b* of the guide rail 2 having the T-shaped cross section. The sensors 7*c* and 7*d* are disposed with a predetermined distance in the longitudinal direction of the guide rail 2.

Figure 3:
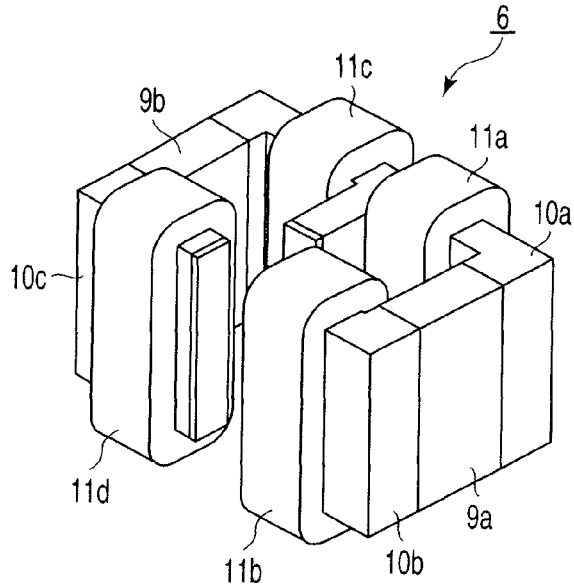
FIG. 3 is a perspective view showing the structure of a magnet unit which is provided in the magnetic guide apparatus according to the first embodiment.

FIG. 3 is a perspective view showing the structure of the magnet unit 6 which is provided in the magnetic guide apparatus 5.

The magnet unit 6 comprises permanent magnets 9*a* and 9*b*, yokes 10*a*, 10*b* and 10*c*, and coils 11*a*, 11*b*, 11*c* and 11*d*. The yokes 10*a*, 10*b* and 10*c* have their magnetic poles opposed to the guide rail 2 in such a manner as to surround the guide rail 2 in three directions. The coils 11*a*, 11*b*, 11*c* and 11*d* are wound around the yokes 10*a*, 10*b* and 10*c* functioning as iron cores, thus constituting electromagnets whose magnetic fluxes at magnetic pole portions can be controlled.

With the above-described structure, the coils 11 are excited on the basis of the quantity of state in a magnetic circuit, which is detected by the gap sensors 7, etc. If the coils 11 are excited, the guide rail 2 and the magnet unit 6 are spaced apart by the magnetic force that is generated, and the car 4 is levitated.

Figure 4:
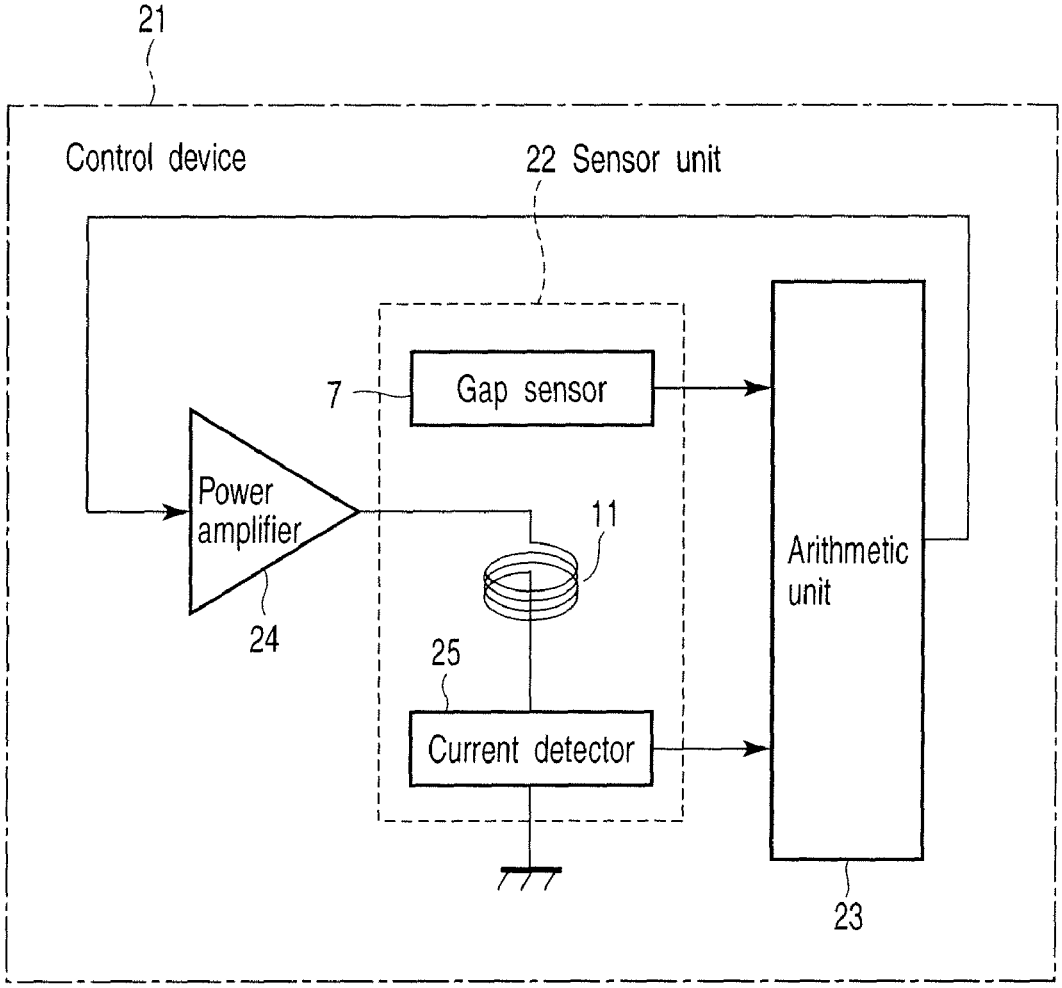
FIG. 4 is a block diagram showing the structure of a control device for controlling the magnetic guide apparatus according to the first embodiment.

FIG. 4 is a block diagram showing the structure of a control device 21 for controlling the magnetic guide apparatus 5.

The control device 21 includes a sensor unit 22, an arithmetic unit 23 and a power amplifier 24. The control device 21 controls the attraction force of the magnet unit 6 which is disposed at each of the four corners of the car 4. For the purpose of convenience, FIG. 4 depicts the sensor unit 22 as being included in the control device 21. Actually, the sensor unit 22 is provided on the magnet unit 6 side.

The arithmetic unit 23 calculates a voltage which is to be applied to each coil 11, on the basis of a signal which is output from the sensor unit 22. The power amplifier 24 supplies power to each coil 11 on the basis of the output from the arithmetic unit 23.

The sensor unit 22 is composed of a gap sensor 7 (7*a* to 7*d*) and a current detector 25. The gap sensor 7 is a sensor for detecting the size of the gap between the magnet unit 6 of the magnetic guide apparatus 5 and the guide rail 2. The current detector 25 detects the value of an electric current which flows in each coil 11.

With the above-described structure, the current which excites each coil 11 is controlled so as to keep a predetermined gap length between the magnet unit 6 and the guide rail 2. In the state in which the car 4 is supported non-contactly, the value of the current flowing in each coil 11 at this time is fed back via an integrator. Thereby, in a steady state, the car 4 can stably be supported by the attraction force of the permanent magnets 9, regardless of the weight of the car 4 and the magnitude of unbalanced force. This control is called "zero-power control".

By this zero-power control, the car 4 can stably be supported in the state in which the car 4 is not in contact with the guide rails 2. In addition, in the steady state, the current flowing in each coil gradually decreases to zero, the force that is needed for stable support becomes only the magnetic force of the permanent magnets 9.

This also applies to the case in which the weight or balance of the car 4 varies. Specifically, in a case where some external force acts on the car 4, an electric current is caused to transitionally flow in the coils 11, thereby to adjust the gap between the magnet unit 6 and guide rail 2 at a predetermined size. However, in the case where the car 4 has transitioned into the stable state once again, the current flowing in the coil 11 gradually decreases to zero by the above-described control method. It is thus possible to form a gap which has such a size that the load acting on the car 4 and the attraction force produced by the magnetic force of the permanent magnet 9 are balanced.

The structure of the magnet unit and the zero-power control are described in detail in Jpn. Pat. Appln. KOKAI Publications No. 2005-350267 and No. 2001-19286, and a detailed description thereof is omitted here.

(Gap Sensor)

A plurality of gap sensors 7 are disposed so that the distances in the respective directions of magnetic force control can be detected. The gap sensors 7 are disposed with a predetermined distance in the direction of movement of the car 4, with the magnetic unit 6 being interposed.

In the present embodiment, as shown in FIG. 2, the gap sensors 7*a* and 7*b* for detecting the distance in the right-and-left direction of the car 4 are disposed above and below the magnet unit 6, respectively. In addition, the gap sensors 7*c* and 7*d* for detecting the distance in the back-and-forth direction of the car 4 are disposed above and below the magnet unit 6, respectively. The same applies to all magnetic guide apparatuses 5 which are disposed at the four corners of the car 4.

Next, a description is given of how the gap sensors disposed on the magnetic guide apparatus 5 respond, when the magnetic guide apparatus 5 passes by the stepped portion or joint of the guide rail 2 with the movement of the car 4. In the description below, the gap sensors 7*a* and 7*b* are exemplified. However, the same applies to the other gap sensors 7*c* and 7*d*.

It is assumed that a detection signal which is output from the gap sensor 7*a* is Ga, and a detection signal which is output from the gap sensor 7*b* is Gb.

FIG. 5 to FIG. 8 show the states in which the car 4 runs upward along the guide rails 2. In FIG. 5 to FIG. 8, reference numeral 2*c* denotes a joint of the guide rail 2. FIG. 9 shows signal waveforms of the gap sensors 7*a* and 7*b*.

Figure 5:
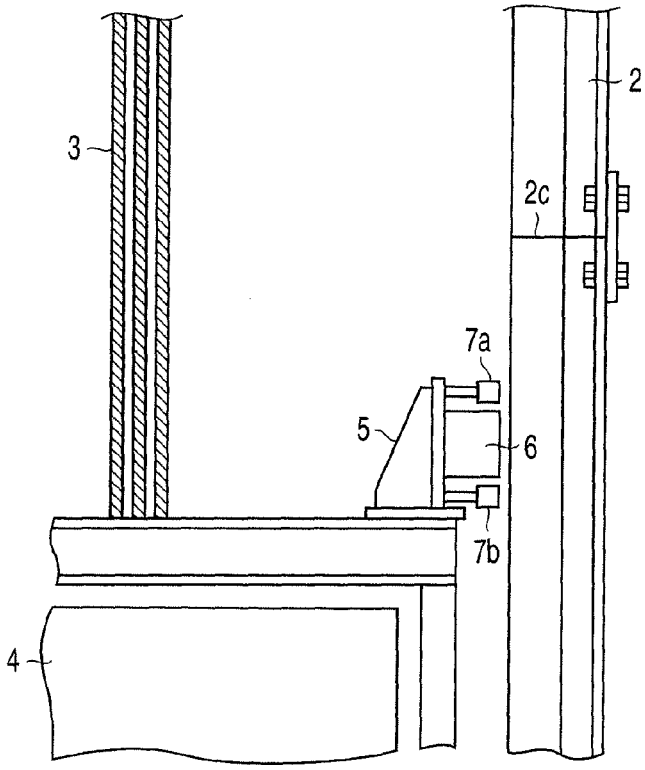
FIG. 5 shows a positional relationship between gap sensors of the magnetic guide apparatus according to the first embodiment and guide rails.

As shown in FIG. 5, in the case where the gap sensors 7*a* and 7*b* are opposed to a continuous part of the guide rail 2, the detection signals Ga and Gb, which are output from the gap sensors 7*a* and 7*b*, have smooth response characteristics. In this state, the gap between the magnet unit 6 and the guide rail 2 can exactly be detected by the gap sensors 7*a* and 7*b*.

Figure 6:
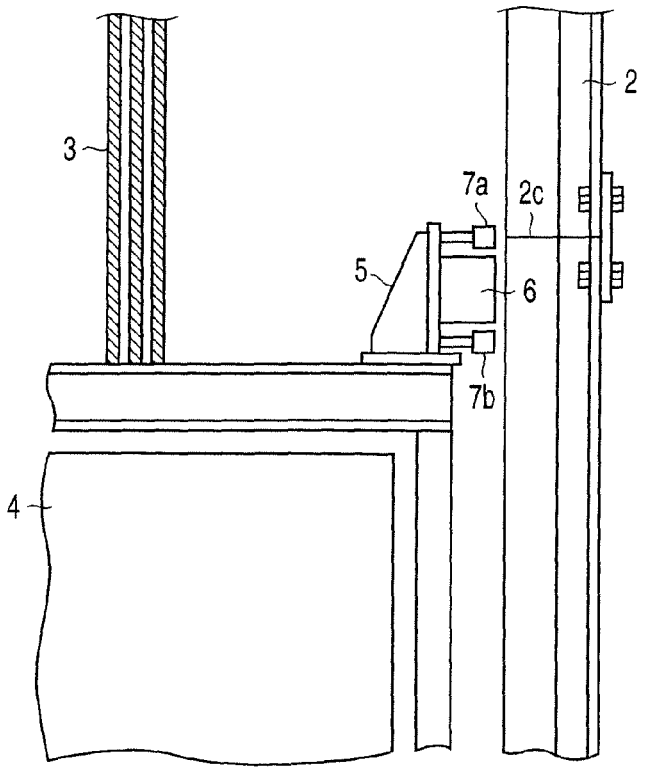
FIG. 6 shows a positional relationship between the gap sensors of the magnetic guide apparatus according to the first embodiment and guide rails.

As shown in FIG. 6, if the car 4 approaches the joint 2*c* of the guide rail 2, the gap sensor 7*a* first passes by the joint 2*c* of the guide rail 2. At this time, as shown in a part A in FIG. 9, the detection signal Ga of the gap sensor 7*a* is greatly disturbed due to, e.g. a variation in material characteristics of the part of the joint 2*c*. On the other hand, the gap sensor 7*b*, which has not yet approached the part of the joint 2*c* of the guide rail 2, responds smoothly at this time.

Figure 7:
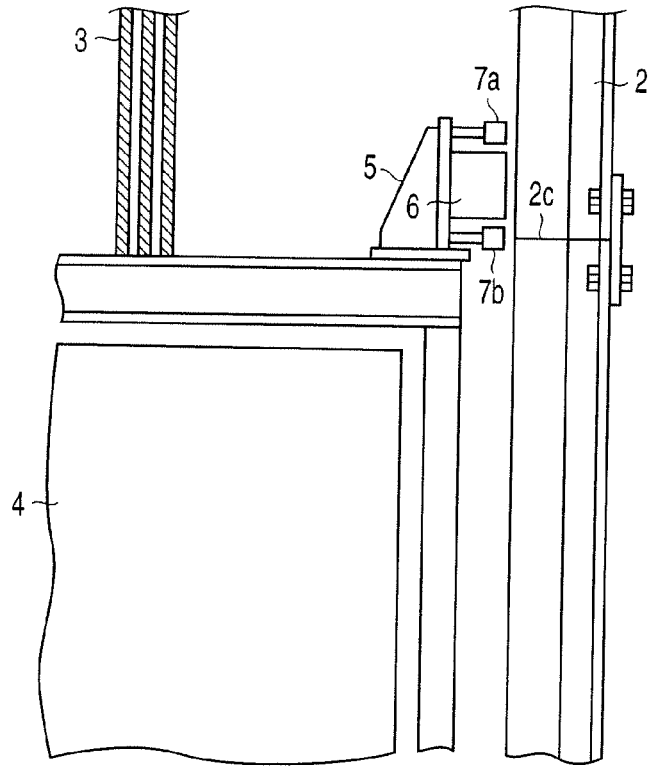
FIG. 7 shows a positional relationship between the gap sensors of the magnetic guide apparatus according to the first embodiment and guide rails.

As shown in FIG. 7, if the gap sensor 7*b* passes by the vicinity of the joint 2*c*, the detection signal Gb of the gap sensor 7*b* is greatly disturbed instantaneously, as shown in a part B in FIG. 9. On the other hand, the detection signal Ga of the gap sensor 7*a* restores to the smooth state.

Figure 8:
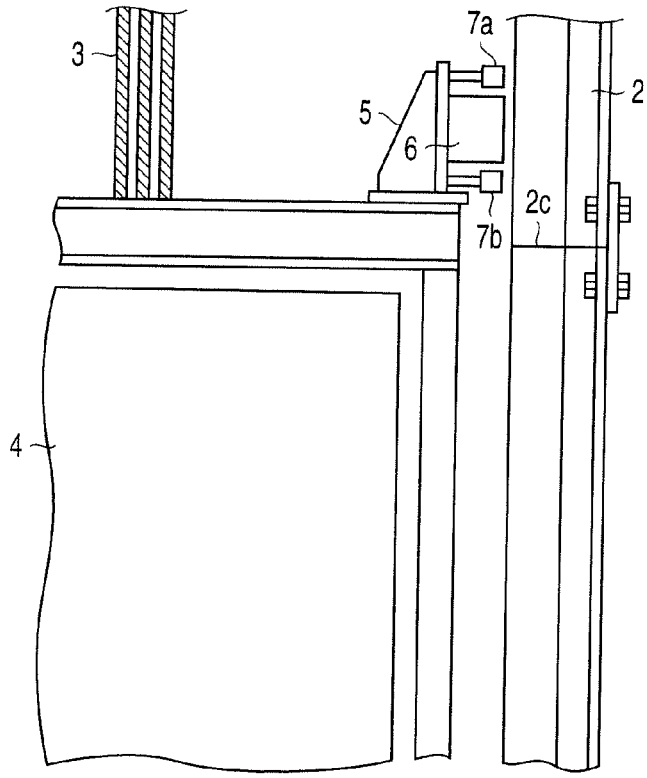
FIG. 8 shows a positional relationship between the gap sensors of the magnetic guide apparatus according to the first embodiment and guide rails.
Figure 9:
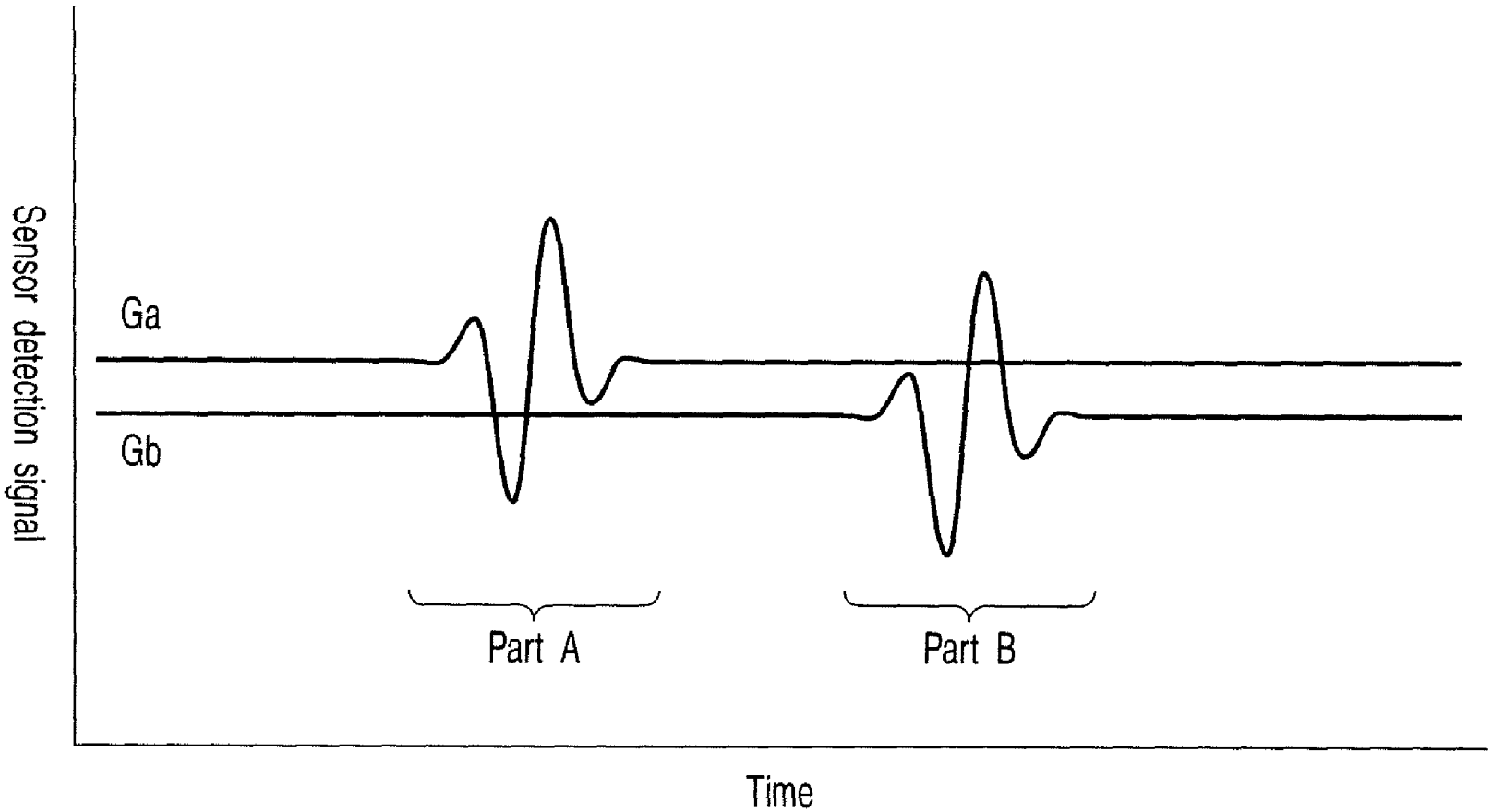
FIG. 9 is a graph showing signal waveforms of the gap sensors of the magnetic guide apparatus according to the first embodiment.

As shown in FIG. 8, after the gap sensors 7*a* and 7*b* have passed by the joint 2*c* of the guide rail 2, the continuous part of the guide rail 2 becomes an object of detection. In this state, both the gap sensors 7*a* and 7*b* respond smoothly, and the gap between the magnet unit 6 and the guide rail 2 can exactly be detected.

As has been described above, if the detection signal Ga, Gb is greatly disturbed at the joint 2*c* of the guide rail 2, a displacement signal, which is not related to the actual movement of the car 4, is delivered to the control device 21. Consequently, the magnetic control becomes unstable, and the car 4 is unnecessarily shaken.

In other words, if the detection signals Ga and Gb are disturbed, as shown in the parts A and B in FIG. 9, the control device 21 erroneously recognizes shaking of the car 4. As a result, the control device 21 controls the magnetic guide apparatus 5 in such a direction as to suppress the shaking, and thus shakes the car 4.

(Signal Correction Process)

In order to solve the above-described problem, it can be thought to control the magnetic force, for example, by using an average value of the two detection signals Ga and Gb. However, in this method, although the disturbance of the detection signal can be reduced, the disturbance itself remains, and smooth control cannot be executed.

Figure 10:
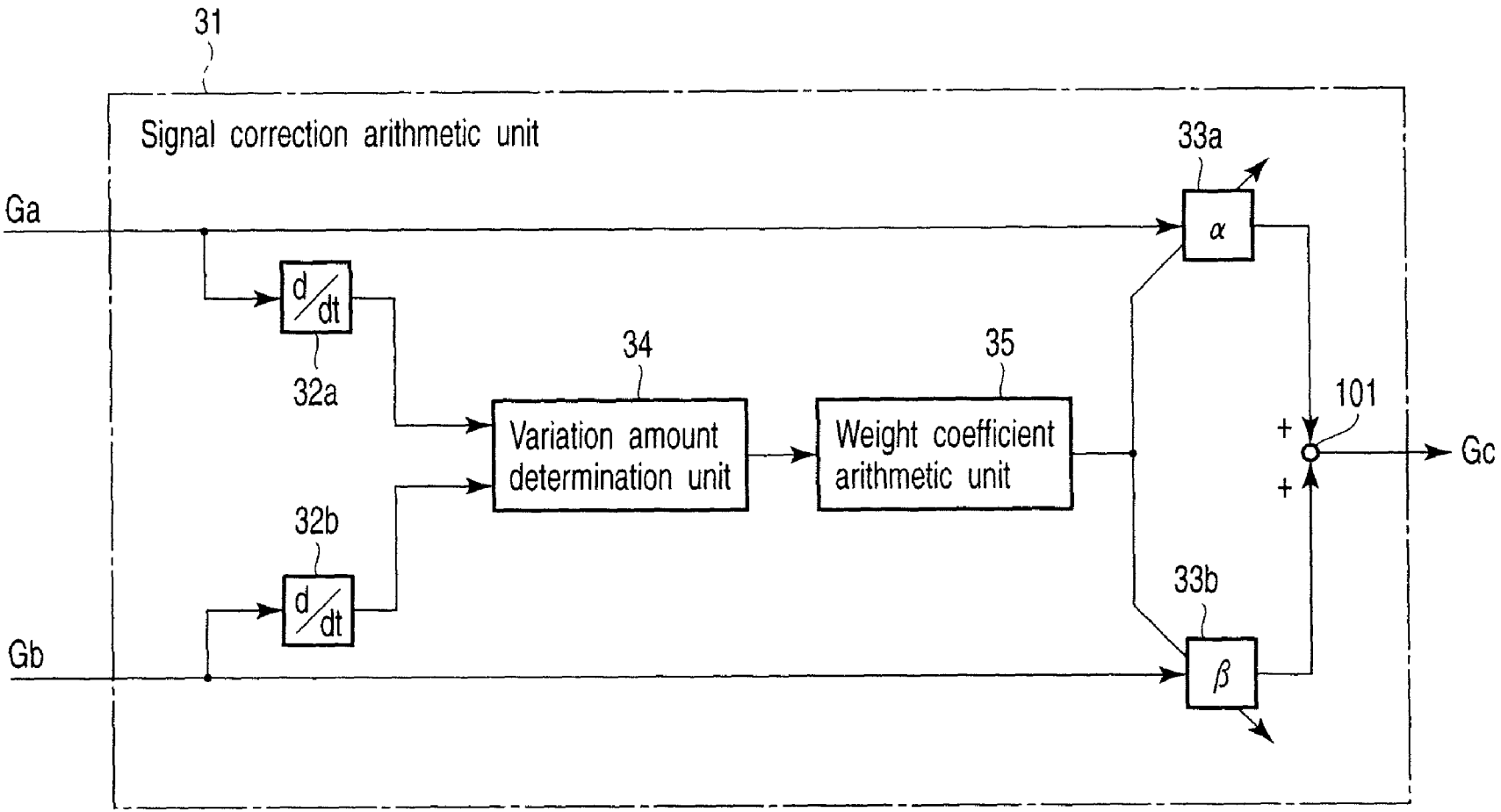
FIG. 10 is a block diagram showing the structure of a signal correction arithmetic unit in the first embodiment.

To cope with this, in the present embodiment, a signal correction arithmetic unit 31, as shown in FIG. 10, is used. The signal correction arithmetic unit 31 is included in the arithmetic unit 23 shown in FIG. 4. The signal correction arithmetic unit 31 receives the detection signal Ga that is output from the gap sensor 7*a*, and the detection signal Gb that is output from the gap sensor 7*b*, and generates and outputs a signal Gc in which the disturbances of the detection signals Ga and Gb are corrected.

As shown in FIG. 10, the signal correction arithmetic unit 31 comprises differentiators 32*a* and 32*b*, a variation amount determination unit 34, a weight coefficient arithmetic unit 35, weight coefficient multipliers 33*a* and 33*b*, and an adder 101.

The differentiator 32*a* differentiates the detection signal Ga of the gap sensor 7*a*. The differentiator 32*b* differentiates the detection signal Gb of the gap sensor 7*b*. If the detection signals Ga and Gb are differentiated, their variation amounts can be found.

Actually, it is not possible to fabricate a "differentiator" which can perform an exact differential arithmetic operation. Thus, in usual cases, a "quasi-differentiator" is used. The term "differentiator", in this description, includes the "quasi-differentiator".

The variation amount determination unit 34 determines variation amounts of the detection signals Ga and Gb, on the basis of outputs from the differentiators 32*a* and 32*b*. The weight coefficient arithmetic unit 35 calculates weight coefficients α and β, by which the detection signals are to be multiplied, on the basis of the determination result of the variation amount determination unit 34.

The weight coefficient multiplier 33*a* multiplies the detection signal Ga by the weight coefficient α that is calculated by the weight coefficient arithmetic unit 35. The weight coefficient multiplier 33*b* multiplies the detection signal Gb by the weight coefficient β that is calculated by the weight coefficient arithmetic unit 35. The adder 101 adds the detection signal Ga that is multiplied by the weight coefficient α, and the detection signal Gb that is multiplied by the weight coefficient β. The obtained addition signal is used as a signal for magnetic control.

In the above-described structure, the signal correction arithmetic unit 31 differentiates the detection signal Ga of the gap sensor 7*a* and the detection signal Gb of the gap sensor 7*b*, thereby finding their variation amounts. On the basis of the variation amounts, the signal correction arithmetic unit 31 multiplies the detection signals Ga and Gb by the weight coefficients α and β.

The weight coefficient α, β can take a value in a range of between 0 and 1. In accordance with the variation amounts of the two detection signals Ga and Gb, the weight coefficient arithmetic unit 35 adjusts the weight coefficients α and β so that the sum of the weight coefficients α and β becomes 1. In this case, the weight coefficient for the detection signal with a smaller variation amount is increased, and the weight coefficient for the detection signal with a larger variation amount is decreased.

In this manner, the weight coefficients α and β are determined in accordance with the variation amounts of the detection signals Ga and Gb. After the signal correction arithmetic unit 31 multiplies the detection signals Ga and Gb by the weight coefficients α and β, the signal correction arithmetic unit 31 generates the signal Gc which is obtained by adding the multiplied signals.

The output signal Go is expressed by the following equation (1):

$$Gc=(\alpha\times Ga)+(\beta\times Gb) \quad (1)$$

$\alpha+\beta=1,\ 0\leqq\alpha\leqq1,\ 0\leqq\beta\leqq1.$

The output signal Gc is a signal in which the ratio of one of the detection signals Ga and Gb, which has a smaller variation amount, is increased. Accordingly, by using the output signal Go as a signal for magnetic control, stable control can always be executed, no matter which of the detection signals Ga and Gb is disturbed.

In the case where the weight coefficient α, β, by which the detection signal Ga, Gb is multiplied, is varied, the weight coefficient α, β is continuously varied. Thereby, a sharp signal variation can be suppressed, and smooth control can be executed.

In a method of continuously varying the weight coefficient α, β, an upper limit value is set to an instruction value of the weight coefficient arithmetic unit 35 or to the variation ratio of the weight coefficient α, β, and only a variation within the range of the variation ratio is tolerated. Alternatively, a low-pass filter having a predetermined delay may be used to determine the weight coefficient α, β.

Figure 11:
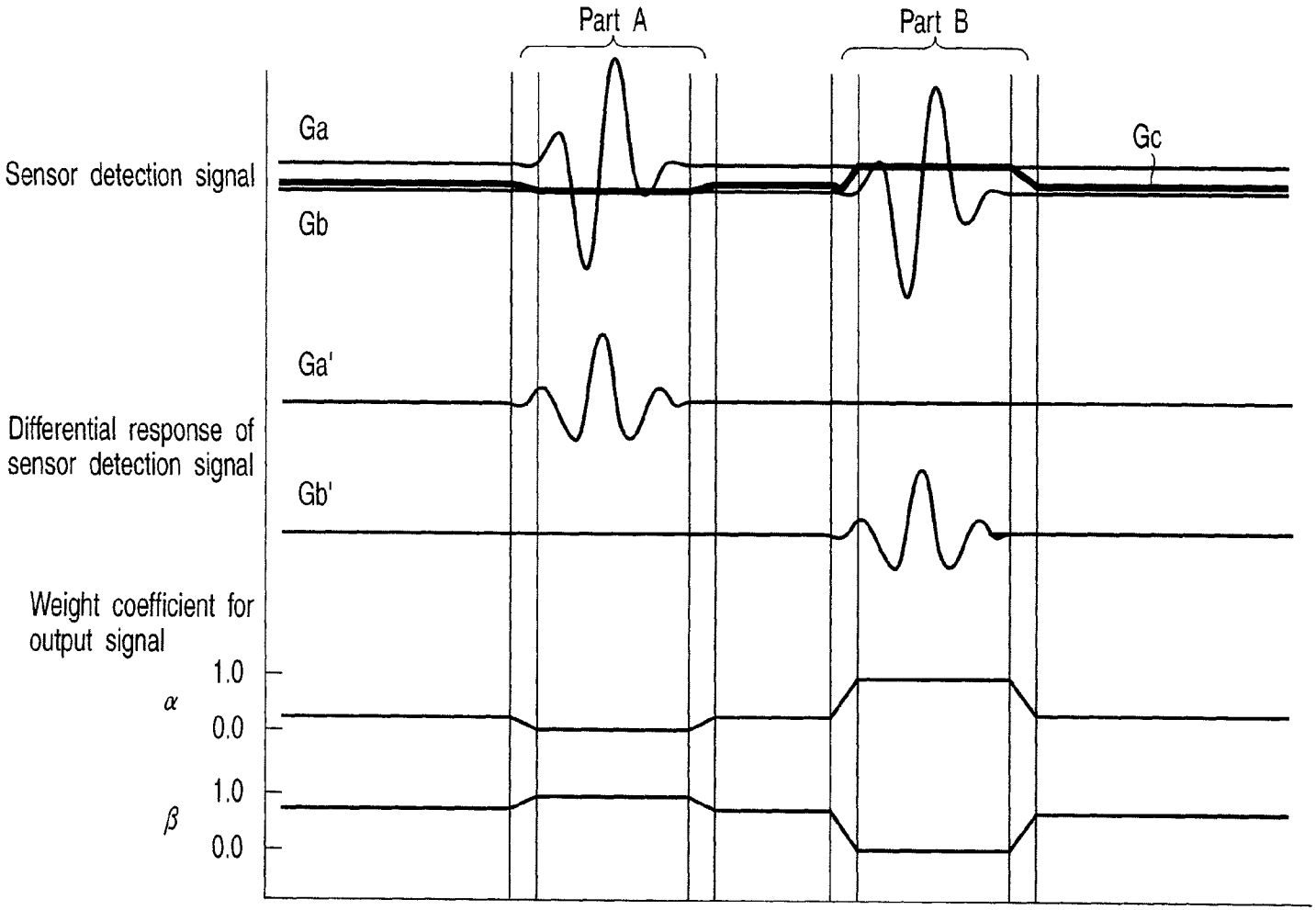
FIG. 11 is a graph showing response characteristics of respective signals in the signal correction arithmetic unit in the first embodiment.

FIG. 11 is a graph showing response characteristics of respective signals in the signal correction arithmetic unit 31.

It is now assumed that a detection signal which is output from the gap sensor 7*a* is Ga, a detection signal which is output from the gap sensor 7*b* is Gb, and differential signals thereof are Ga' and Gb'.

The differential signal Ga', Gb' sharply varies when the detection signal Ga, Gb is disturbed at the part of the joint 2*c* of the guide rail 2. On the other hand, the differential signal Ga', Gb' hardly varies at the continuous part of the guide rail 2. Accordingly, at a part A in FIG. 11, the absolute value of the differential signal Ga' is greater than that of the differential signal Gb'. By detecting this state by the variation amount determination unit 34, the weight coefficient β for the detection signal Gb with a relatively small variation amount is increased.

Since the weight coefficients α and β are varied so that their sum becomes 1, when the value of β is increased, the value of α is decreased accordingly. Hence, while the value of the differential signal Ga' is large, the value of β becomes 1 or is close to 1, and the value of α becomes 0 or is close to 0. Accordingly, the output signal Gc, which is obtained by adding the detection signals Ga and Gb that are multiplied by the weight coefficients α and β, is indicative of the value of Gb or a value close to Gb.

Conversely, at a part B in FIG. 11 where the value of the detection signal Gb is greatly disturbed, the absolute value of the differential signal Gb' is greater than that of the differential signal Ga'. In this case, by increasing the value of the weight coefficient α and decreasing the value of the weight coefficient β, the output signal Gc in which the ratio of the detection signal Ga is high is obtained.

In this manner, the output signal Gc with little disturbance is finally generated, and is delivered to the control device 21 as a signal for magnetic control. Therefore, even if the detection signal Ga, Gb is disturbed at the part of the joint 2*c* of the guide rail 2, the car 4 is not unnecessarily shaken, stable magnetic control is always executed, and the car 4 can noncontactly be run and guided.

Second Embodiment

Next, a second embodiment of the present invention is described.

In the second embodiment, the detection signal Ga of the gap sensor 7*a* and the detection signal Gb of the gap sensor 7*b* are subjected to second-order differentiation. The structure of the magnetic guide apparatus 5, etc., are the same as in the first embodiment.

Figure 12:
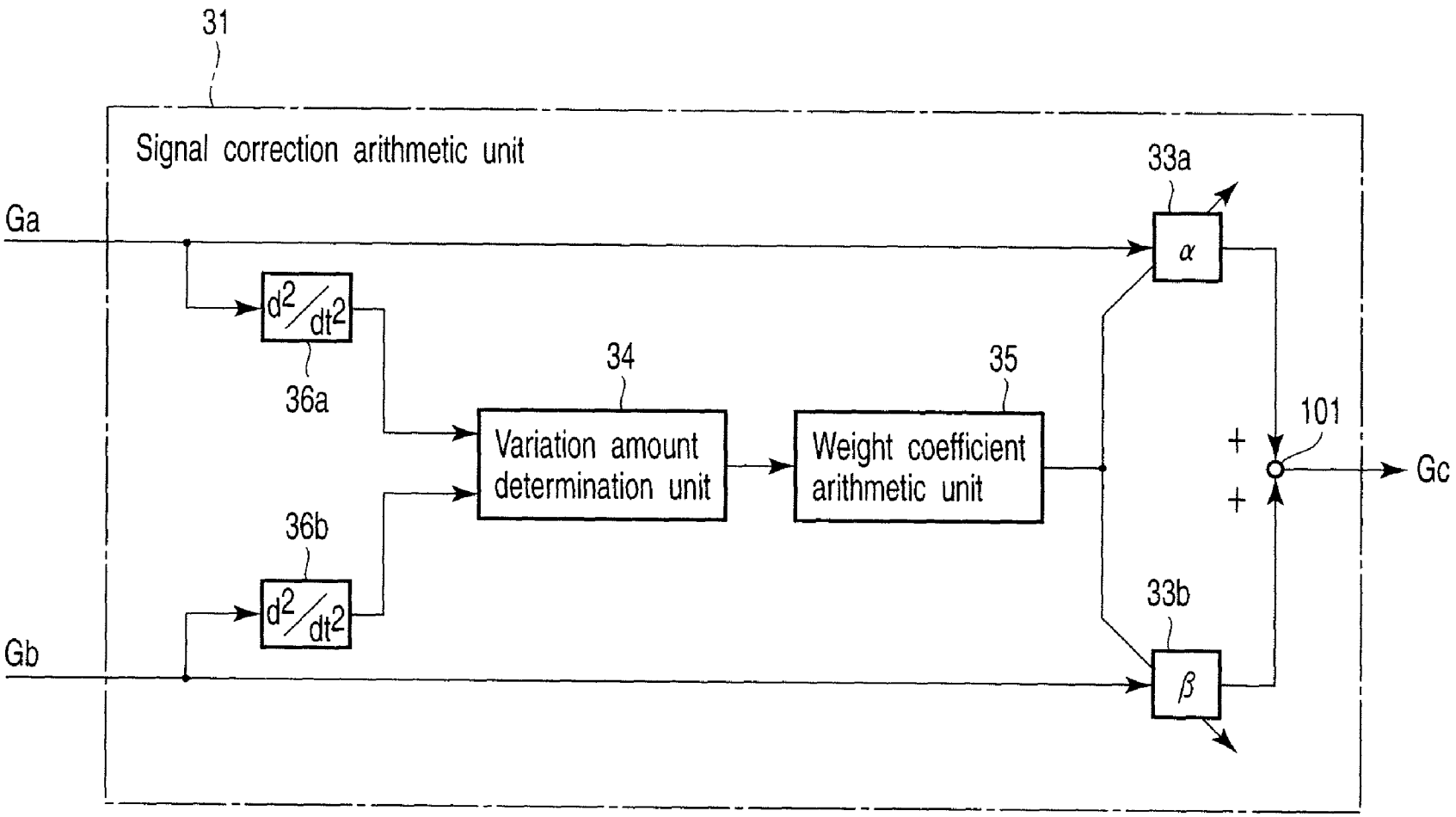
FIG. 12 is a block diagram showing the structure of a signal correction arithmetic unit according to a second embodiment of the present invention.

FIG. 12 is a block diagram showing the structure of a signal correction arithmetic unit 31 according to the second embodiment of the present invention. The structural parts common to those of the first embodiment shown in FIG. 10 are denoted by like reference numerals, and a description thereof is omitted here.

In the second embodiment, the signal correction arithmetic unit 31 is provided with second-order differentiators 36*a* and 36*b* in place of the above-described differentiators 32*a* and 32*b*. Specifically, in the first embodiment, the detection signal Ga of the gap sensor 7*a* and the detection signal Gb of the gap sensor 7*b* are subjected to first-order differentiation, and thereby the variation amounts of both detection signals Ga and Gb are detected. By contrast, in the second embodiment, the variation amounts are detected by second-order differentiation. With respect to the other structure, the second embodiment is similar to the first embodiment.

Figure 13:
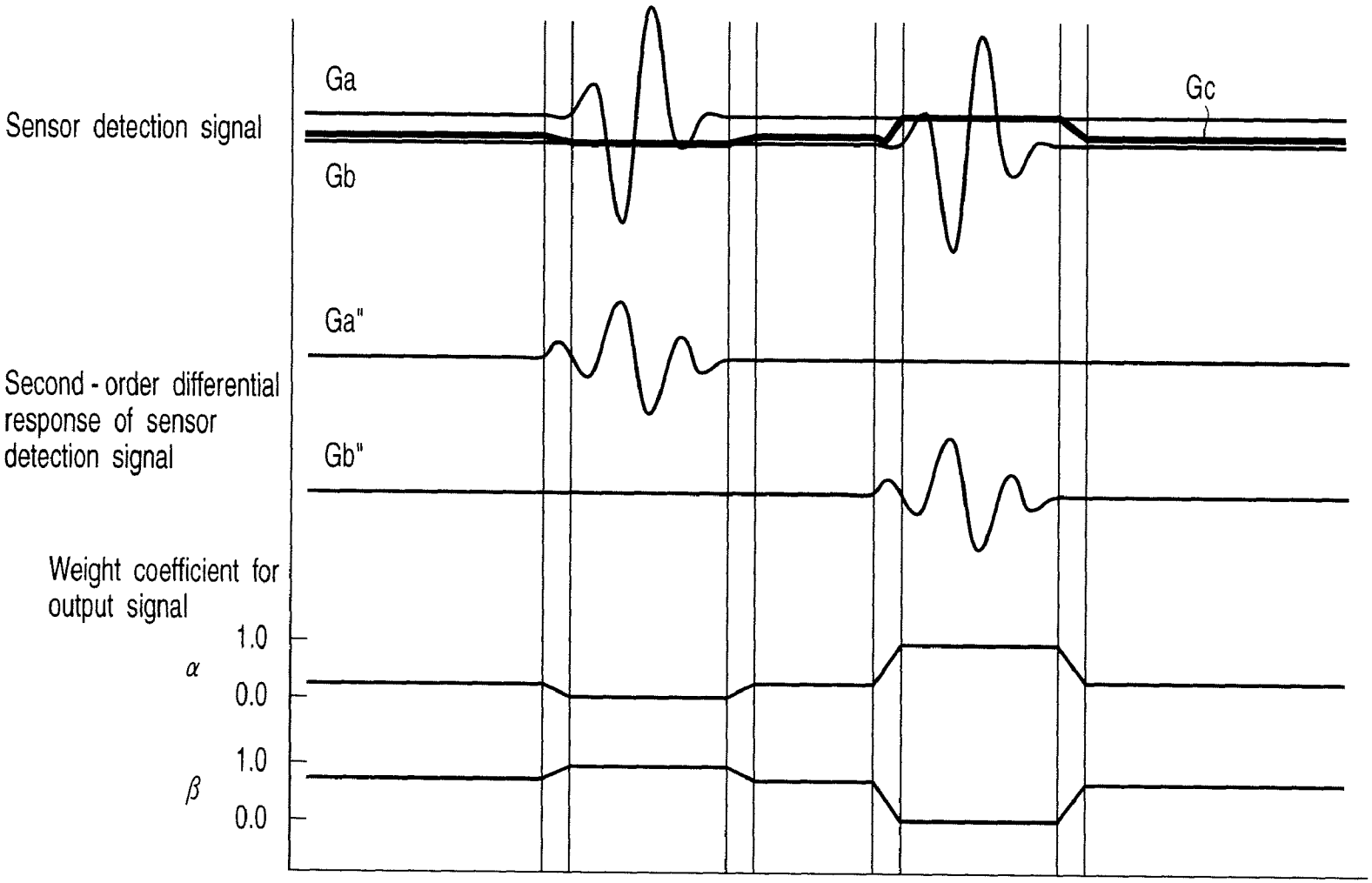
FIG. 13 is a graph showing response characteristics of respective signals in the signal correction arithmetic unit in the second embodiment.

FIG. 13 shows response characteristics of respective signals in this signal correction arithmetic unit 31.

It is assumed that a detection signal which is output from the gap sensor 7*a* is Ga, a detection signal which is output from the gap sensor 7*b* is Gb, and second-order differential signals thereof are Ga" and Gb".

The second-order differential signal Ga", Gb" sharply varies when the detection signal Ga, Gb is disturbed at the part of the joint 2*c* of the guide rail 2. In this case, the variation amounts appear more conspicuously in the second-order differentiation than in the first-order differentiation. The second-order differential signal Ga", Gb" is delivered to the variation amount determination unit 34 as a signal representative of the variation amount of the detection signal Ga, Gb.

The subsequent operation is the same as in the first embodiment. Specifically, on the basis of the determination result of the variation amount determination unit 34, the weight coefficient of the detection signal with a smaller variation amount is adjusted to a greater degree, and an ultimate signal Gc for use in magnetic control is output.

In this manner, by adopting the structure for detecting the variation amounts of the sensor signals by the second-order differentiation, the magnitude in variation amount is not simply be considered, but a sensor signal with better continuity of variation is preferentially output. Therefore, with use of an output signal Gc having high temporal continuity, the magnetic force of the magnet unit 6 can smoothly be controlled.

The number of differential orders may further be increased. However, if the number of differential orders is increased, the amount of arithmetic operations increases accordingly. Hence, the number of differential orders should preferably be two or thereabout.

Third Embodiment

Next, a third embodiment of the present invention is described.

The third embodiment is configured such that the determination of variation amounts is executed by using a difference signal between a differential signal which is obtained a predetermined time before, and a differential signal obtained at the present time.

Figure 14:
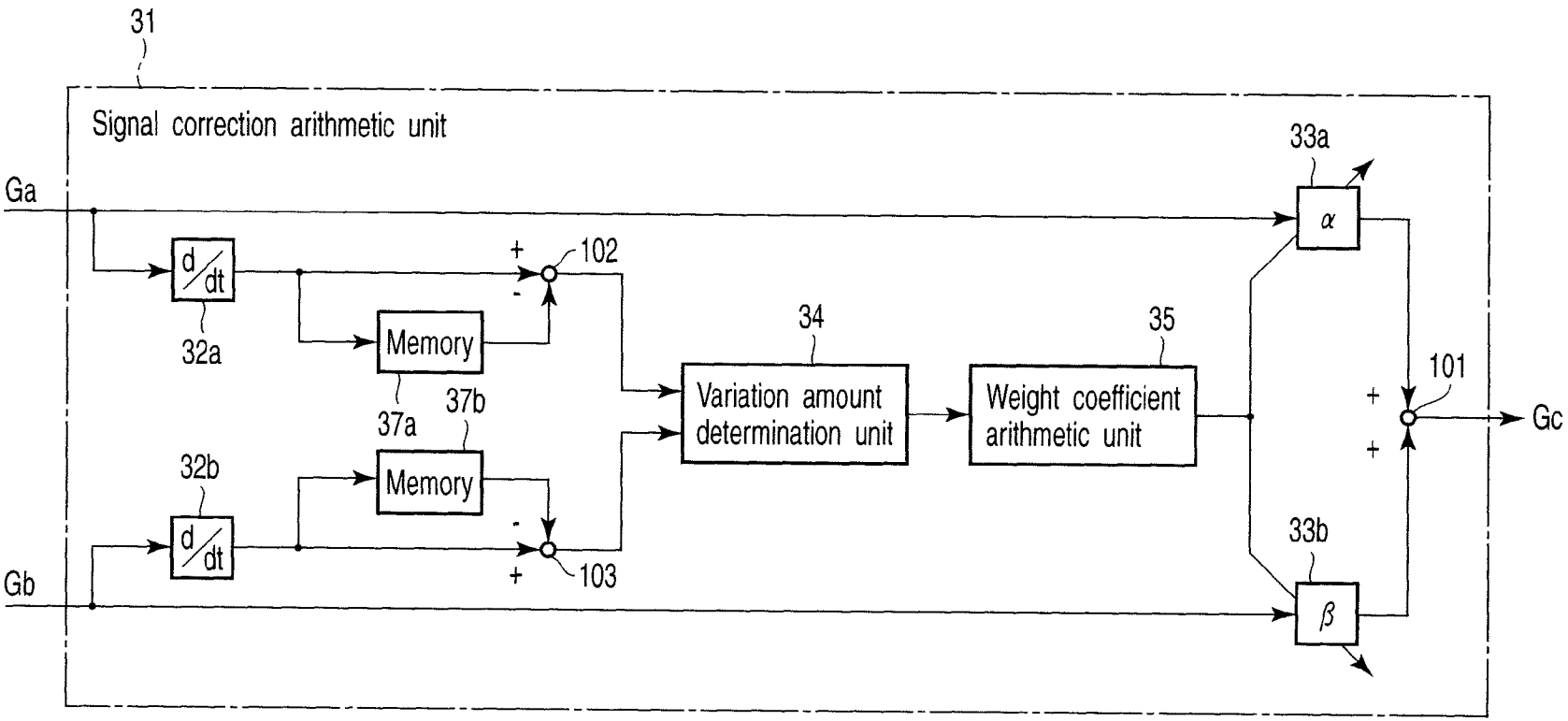
FIG. 14 is a block diagram showing the structure of a signal correction arithmetic unit according to a third embodiment of the present invention.

FIG. 14 is a block diagram showing the structure of a signal correction arithmetic unit 31 according to the third embodiment of the invention. The structural parts common to those of the first embodiment shown in FIG. 10 are denoted by like reference numerals, and a description thereof is omitted here.

In the third embodiment, the signal correction arithmetic unit 31 is provided with a memory 37*a* and a subtracter 102 on an output side of the differentiator 32*a*, and a memory 37*b* and a subtracter 103 on an output side of the differentiator 32*b*.

The memory 37*a* holds a differential signal that is obtained by the differentiator 32*a*. The subtracter 102 calculates a difference between the differential signal, which is obtained a predetermined time before and is held in the memory 37*a*, and a differential signal which is obtained at the present time, and outputs a calculation result to the variation amount determination unit 34.

Similarly, the memory 37*b* holds a differential signal that is obtained by the differentiator 32*b*. The subtracter 103 calculates a difference between the differential signal, which is obtained a predetermined time before and is held in the memory 37*b*, and a differential signal which is obtained at the present time, and outputs a calculation result to the variation amount determination unit 34.

Specifically, in the third embodiment, when the variation amounts of the differential signals Ga and Gb are compared, difference results between differential signals which are obtained by first-order differentiation at the present time and differential signals obtained a predetermined time before are compared. The weight coefficient for the detection signal with a smaller difference is increased.

Figure 15:
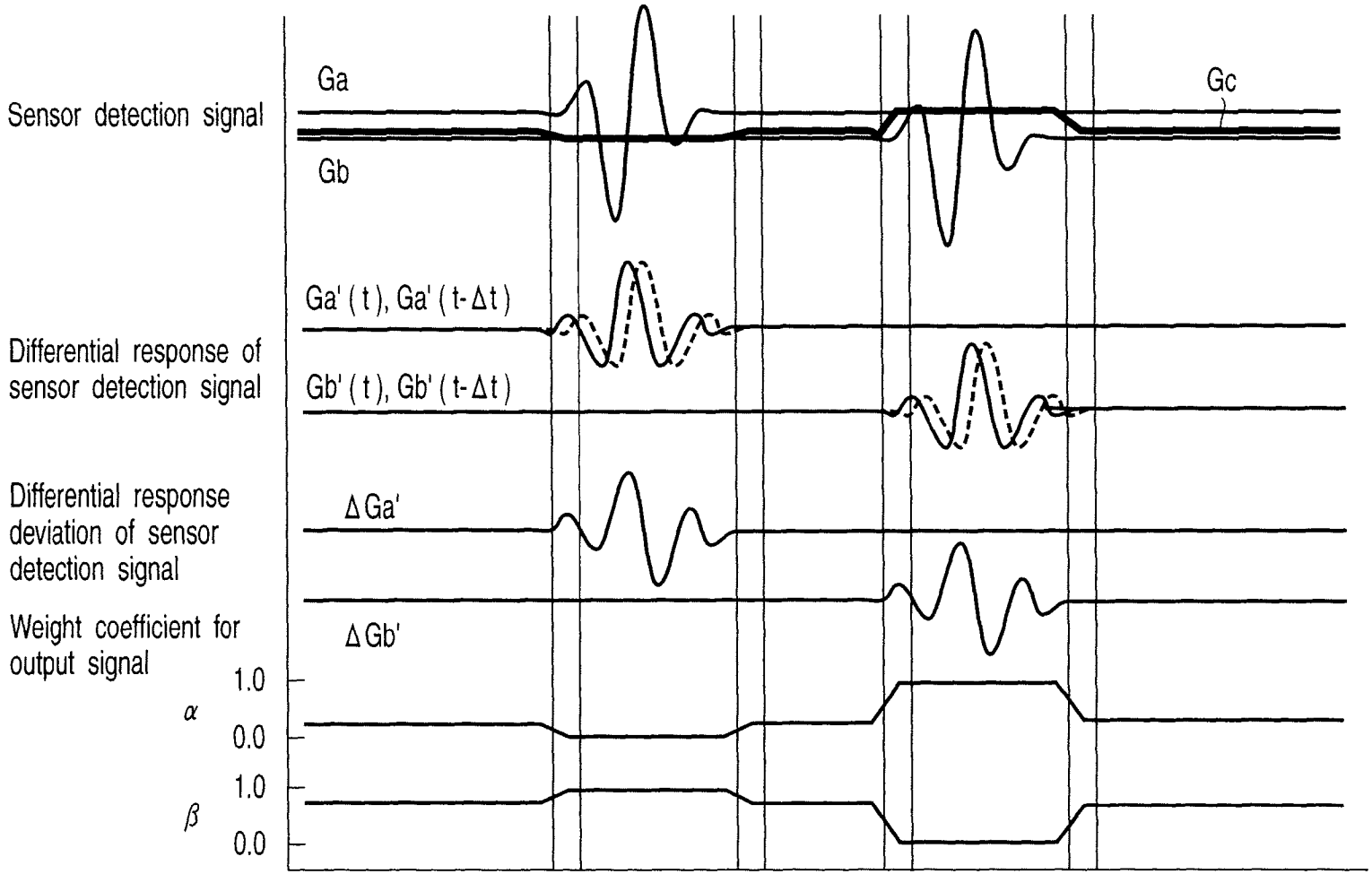
FIG. 15 is a graph showing response characteristics of respective signals in the signal correction arithmetic unit in the third embodiment.

FIG. 15 shows response characteristics of respective signals in the signal correction arithmetic unit 31.

A differential signal at the present time is indicated by a solid line as Ga'(t), Gb'(t). A differential signal, which is delayed by a predetermined time Δt by the memory 37*a*, 37*b*, is indicated by a broken line as Ga'(t−Δt), Gb'(t−Δt).

Symbol ΔGa' is a difference signal between Ga'(t) and Ga'(t−Δt), and ΔGb' is a difference signal between Gb'(t) and Gb'(t−Δt).

In the above-described structure, the difference signal ΔGa' which is obtained by the subtracter 102 and the difference signal ΔGb' which is obtained by the subtracter 103 are delivered to the variation amount determination unit 34 as signals representative of the variation amounts of the detection signals Ga and Gb. These difference signals ΔGa' and ΔGb' have characteristics which are substantially equal to the characteristics of the signals which are obtained by subjecting the detection signals Ga and Gb to second-order differentiation.

The subsequent operation is the same as in the first embodiment. Specifically, on the basis of the determination result of the variation amount determination unit 34, the weight coefficient of the detection signal with a smaller variation amount is adjusted to a greater degree, and an ultimate signal Gc for use in magnetic control is output.

In this manner, also by executing the comparative determination of the variation amounts by using the difference signal between the preceding and subsequent differential signals, stable magnetic control can always be executed without the influence due to, for example, the shape of the guide rails 2, like the first embodiment, and the car 4 can non-contactly be run and guided. Moreover, since the response characteristics similar to those in the second embodiment can be obtained by only a pair of differentiators, the load of differential arithmetic operations can advantageously be reduced.

Fourth Embodiment

Next, a fourth embodiment of the present invention is described.

In the above-described first to third embodiments, the detection signal Ga of the gap sensor 7*a* and the detection signal Gb of the gap sensor 7*b* are multiplied by the weight coefficients α and β, thereby generating the output signal Gc. By contrast, in the fourth embodiment, a signal (hereinafter referred to as "Gave signal") which is indicative of an average value of the detection signals Ga and Gb is used as a third detection signal, and the Gave signal is multiplied by a weight coefficient γ, thereby generating an output signal Gc.

Figure 16:
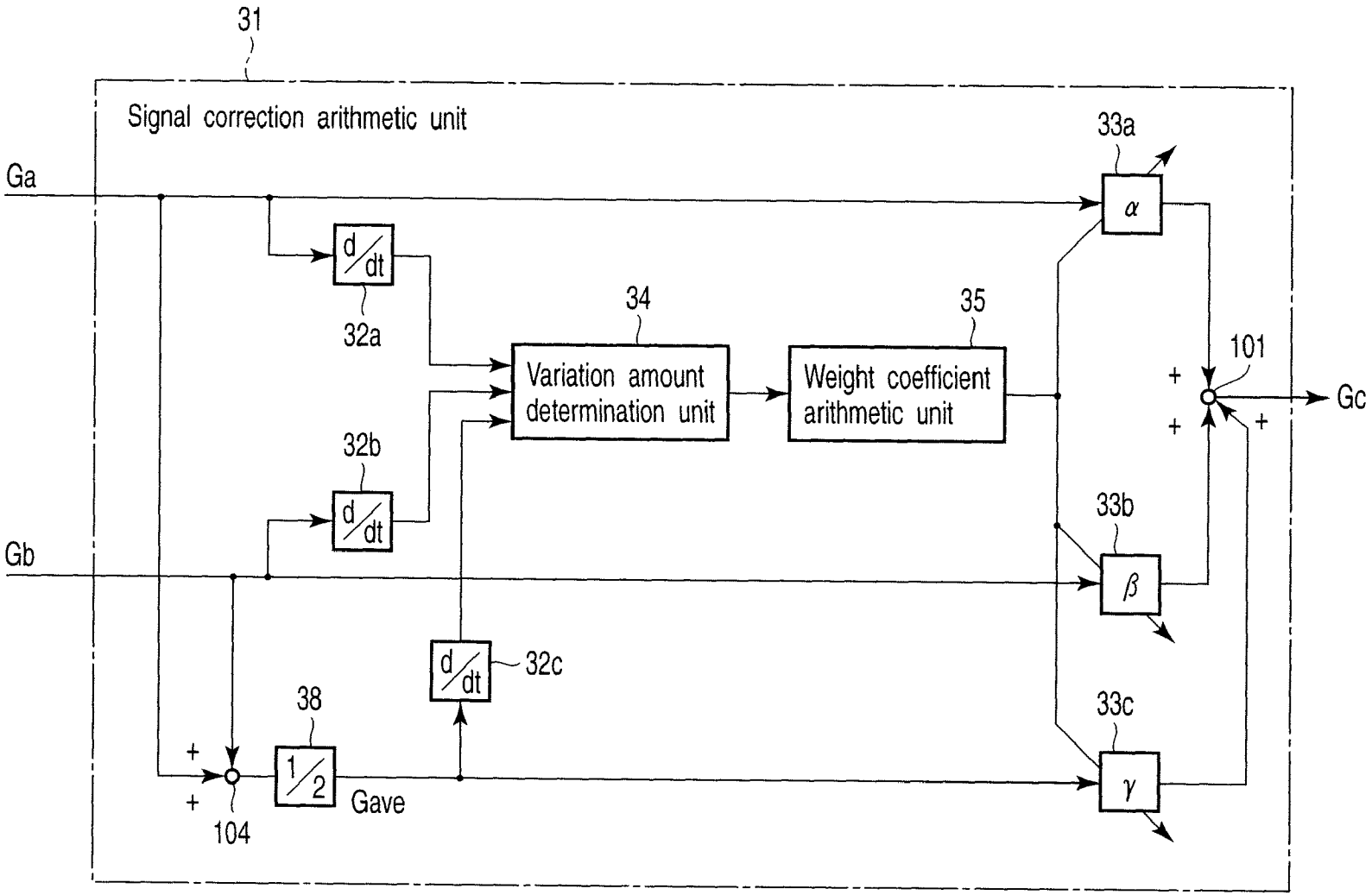
FIG. 16 is a block diagram showing the structure of a signal correction arithmetic unit according to a fourth embodiment of the present invention.
Figure 17:
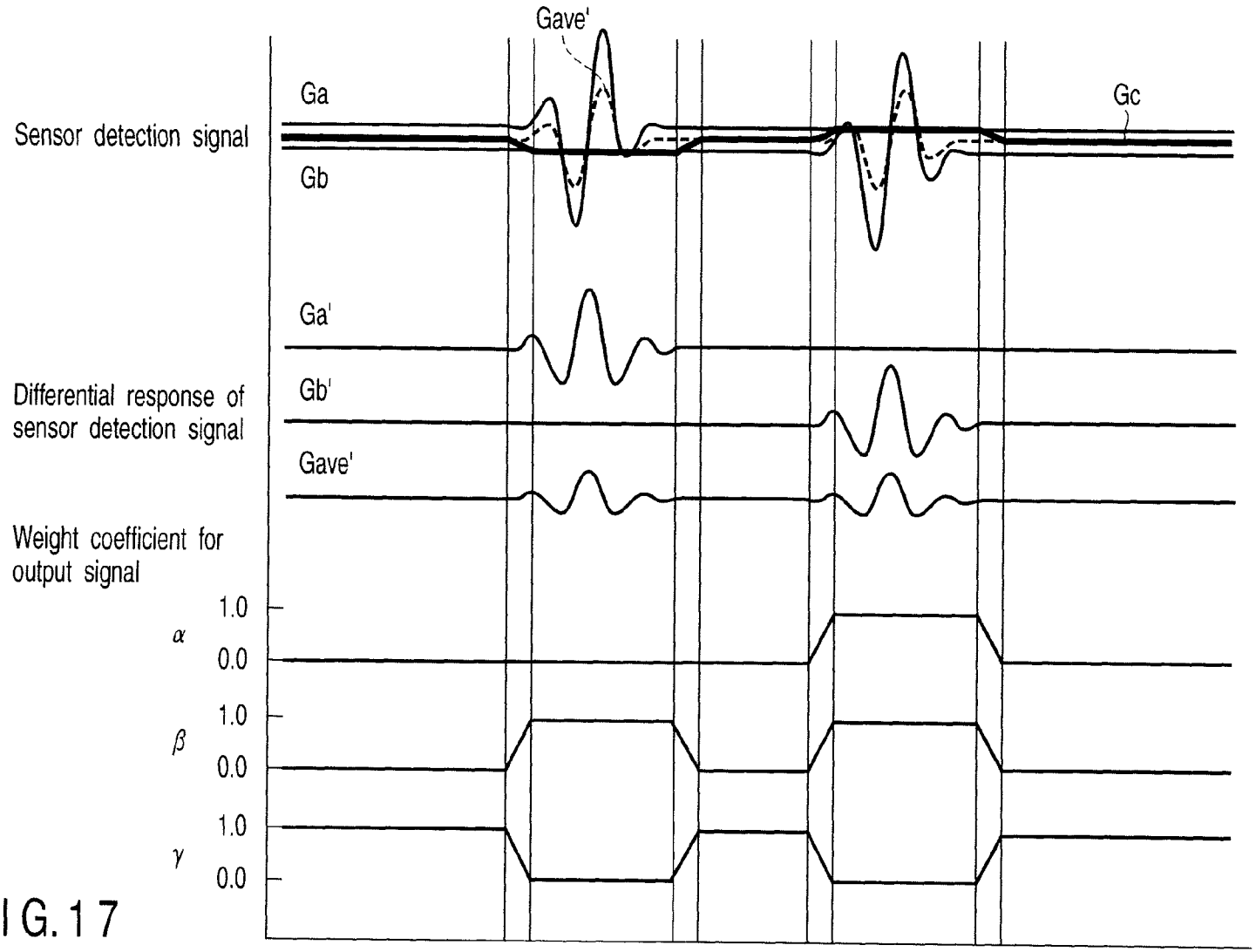
FIG. 17 is a graph showing response characteristics of respective signals in the signal correction arithmetic unit in the fourth embodiment.

FIG. 16 is a block diagram showing the structure of a signal correction arithmetic unit 31 according to the fourth embodiment of the invention. The structural parts common to those of the first embodiment shown in FIG. 10 are denoted by like reference numerals, and a description thereof is omitted here. FIG. 17 is a view showing response characteristics of respective signals in the signal correction arithmetic unit 31.

As shown in FIG. 16, the signal correction arithmetic unit 31 is provided with an adder 104, a ½ arithmetic unit 38, a differentiator 32*c* and a weight coefficient multiplier 33*c*.

The adder 104 adds the detection signal Ga of the gap sensor 7*a* and the detection signal Gb of the gap sensor 7*b*. The ½ arithmetic unit 38 generates a Gave signal which is obtained by halving the addition value of the detection signals Ga and Gb, which is obtained by the adder 104. The Gave signal is delivered to the differentiator 32*c* and weight coefficient multiplier 33*c*.

The differentiator 32*c* subjects the Gave signal to first-order differentiation, and outputs the resultant differential signal to the variation amount determination unit 34. The weight coefficient multiplier 33*c* multiplies the Gave signal by the weight coefficient γ, and outputs the multiplication result to the adder 101.

In the above-described structure, the detection signal Ga of the gap sensor 7*a* and the detection signal Gb of the gap sensor 7*b* are differentiated by the differentiators 32*a* and 32*b*, and the resultant differential signals are delivered to the variation amount determination unit 34. On the other hand, the Gave signal, in which the detection signals Ga and Gb are averaged, is generated via the adder 104 and ½ arithmetic unit 38. The Gave signal is differentiated by the differentiator 32*c*, and the resultant differential signal is delivered to the variation amount determination unit 34.

On the basis of these differential signals, the variation amount determination unit 34 selects the differential signal with a least variation amount from the three signals Ga, Gb and Gave. In addition, the weight coefficient arithmetic unit 35 relatively increases and decreases the weight coefficients α, β and γ so that the sum of the weight coefficients α, β and γ becomes 1. Thereby, the output signal Gc can be generated within the range of the values of the above three signals.

If the values of α and β are set such that only when one of them is 0, the other takes a positive value, $\alpha+\gamma=1$ and $\beta=0$, or $\beta+\gamma=1$ and $\alpha=0$. Accordingly, when the output signal Gc varies from Ga to Gb, or from Gb to Ga, the value of Gave having an intermediate value between Ga and Gb is taken. Thereby, a step at a time of change from Ga to Gb or from Gb to Ga can be reduced. As a result, as shown in FIG. 17, a smoother output signal Gc can be obtained.

As has been described above, a smoother output signal Gc can be obtained by using the Gave signal, which is indicative of the average value of Ga and Gb, as the third detection signal, and multiplying the respective detection signals by the weight coefficients. Thereby, stable magnetic control can always be executed, and the car 4 can non-contactly be run and guided.

Although the structure of the first embodiment has been exemplified in the above description, this embodiment is similarly applicable to the structures of the second and third embodiments.

In the case of the second embodiment, the signal correction arithmetic unit 31 shown in FIG. 12 is additionally provided with an arithmetic unit which generates the Gave signal, and a differentiator which subjects the Gave signal to second-order differentiation. In addition, such a structure is adopted that the output signal of this differentiator is delivered to the variation amount determination unit 34.

In the case of the third embodiment, the signal correction arithmetic unit 31 shown in FIG. 14 is additionally provided with an arithmetic unit which generates the Gave signal, a differentiator which subjects the Gave signal to first-order differentiation, a memory which holds the differential signal of the differentiator, and a subtracter which calculates a difference between the differential signal, which is obtained a predetermined time before and is held in the memory, and a differential signal at the present time. In addition, such a structure is adopted that the output signal of this subtracter is delivered to the variation amount determination unit 34.

Fifth Embodiment

Next, a fifth embodiment of the present invention is described.

The fifth embodiment relates to a pre-process of a sensor signal. Specifically, in the first to fourth embodiments, the detection signal Ga of the gap sensor 7*a* and the detection signal Gb of the gap sensor 7*b* are directly input to the signal correction arithmetic unit 31. By contrast, the fifth embodiment adopts such a structure that after a relative difference between the two detection signals Ga and Gb is corrected, the detection signals are input to the signal correction arithmetic unit 31.

A specific structure of the fifth embodiment is described below.

Figure 18:
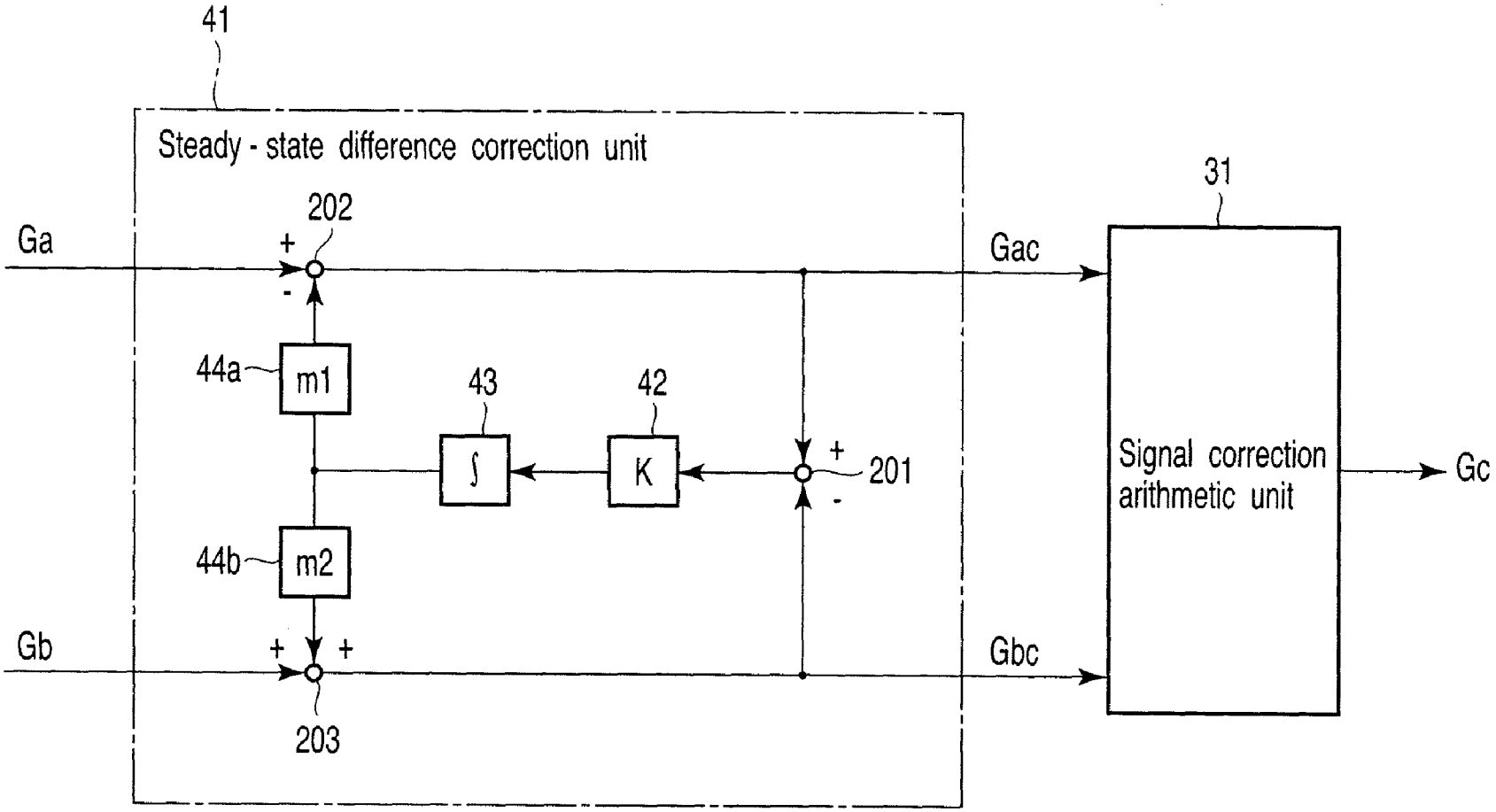
FIG. 18 is a block diagram showing the structure of a steady-state difference correction unit according to a fifth embodiment of the present invention.
Figure 19:
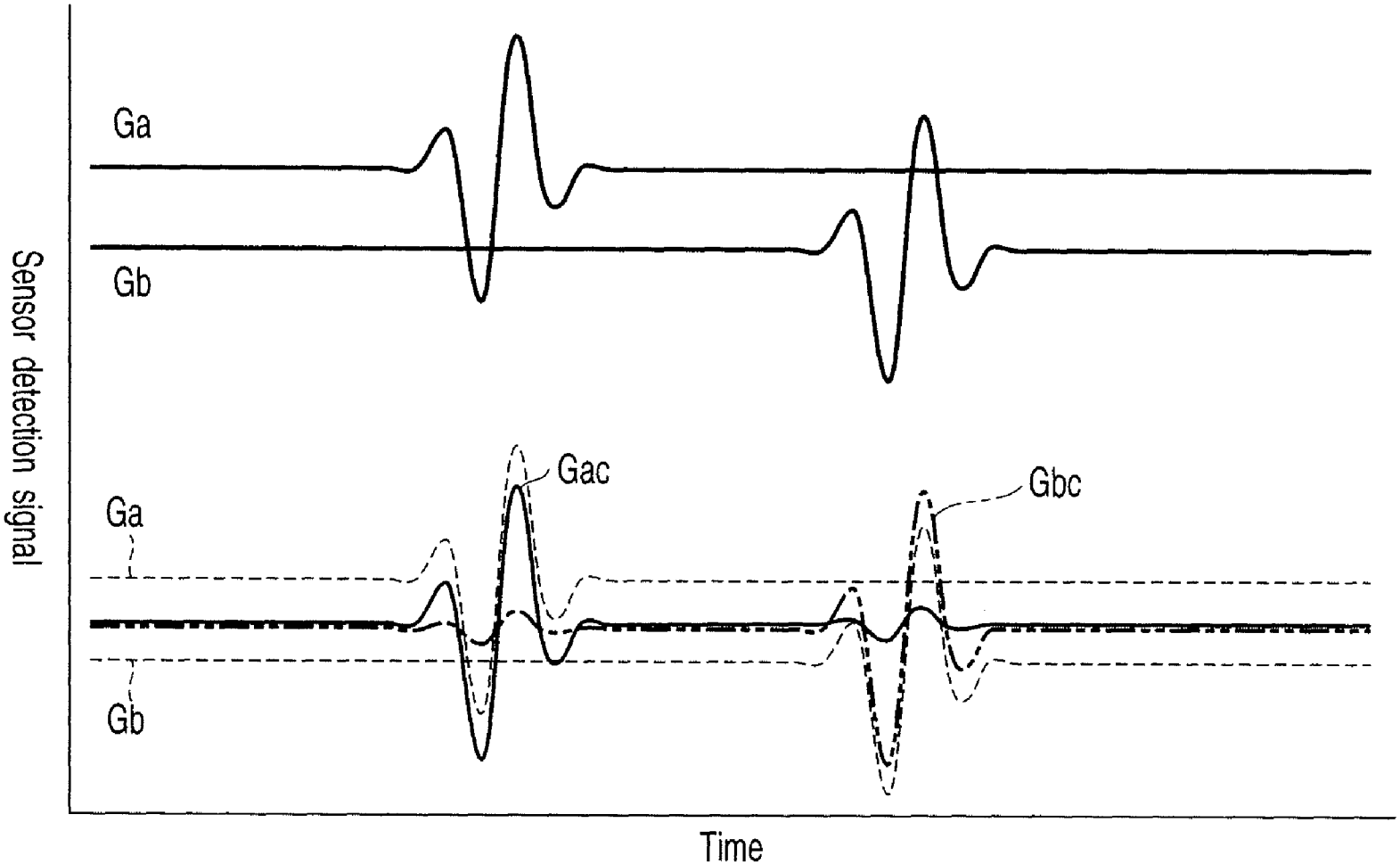
FIG. 19 is a graph showing response characteristics of respective signals in the steady-state difference correction unit in the fifth embodiment.
Figure 20:
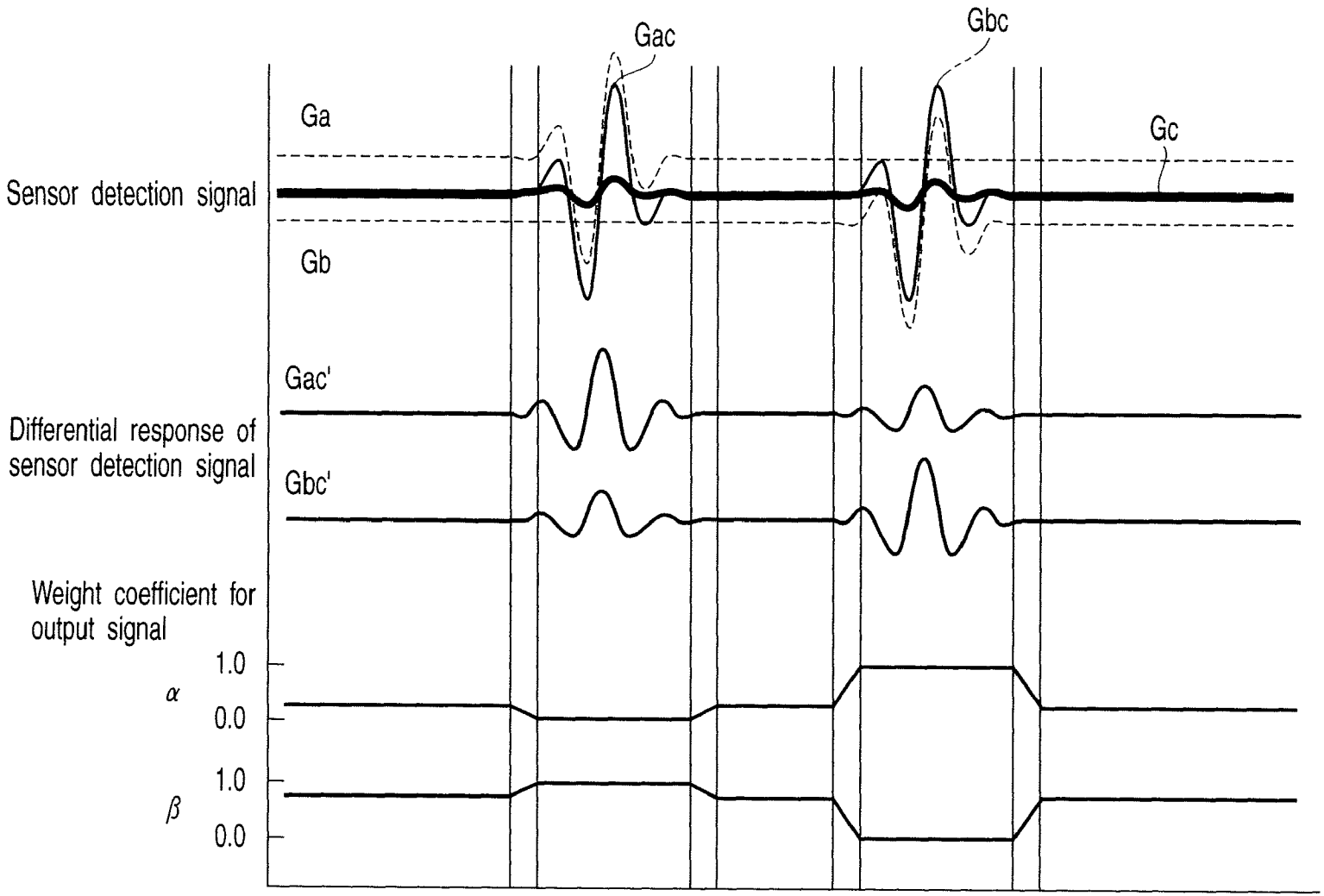
FIG. 20 is a graph showing response characteristics of respective signals in a signal correction arithmetic unit in the fifth embodiment.

FIG. 18 is a block diagram showing the structure of the fifth embodiment of the invention. A steady-state difference correction unit 41 is provided at a front stage of the signal correction arithmetic unit 31. The steady-state difference correction unit 41, together with the above-described signal correction arithmetic unit 31, is provided in the arithmetic unit 23 shown in FIG. 4. FIG. 19 is a graph showing response characteristics of respective signals in the steady-state difference correction unit 41. FIG. 20 is a graph showing response characteristics of respective signals in the signal correction arithmetic unit 31.

As shown in FIG. 18, the steady-state difference correction unit 41 comprises a subtracter 201, a feedback gain multiplier 42, an integrator 43, distribution coefficient multipliers 44*a* and 44*b*, a subtracter 202, and an adder 203.

The subtracter 201 calculates a difference between the detection signal Ga of the gap sensor 7*a* and the detection signal Gb of the gap sensor 7*b*. The feedback gain multiplier 42 multiplies a difference signal between Ga and Gb, which is output from the subtracter 201, by a predetermined feedback gain K, and outputs the resultant signal to the integrator 43. The integrator 43 time-integrates the output signal of the feedback gain multiplier 42 and outputs the resultant signal to each of the distribution coefficient multipliers 44*a* and 44*b*.

The distribution coefficient multiplier 44*a* multiplies the output signal of the integrator 43 by a distribution coefficient m1, and outputs the resultant signal to the subtracter 202. The distribution coefficient multiplier 44*b* multiplies the output signal of the integrator 43 by a distribution coefficient m2, and outputs the resultant signal to the adder 203.

The subtracter 202 calculates a difference between the detection signal Ga, which is input to the steady-state difference correction unit 41, and the feedback signal, and outputs the resultant signal as a corrected detection signal Gac to the signal correction arithmetic unit 31. The adder 203 adds the feedback signal to the detection signal Gb which is input to the steady-state difference correction unit 41, and outputs the resultant signal as a corrected detection signal Gbc to the signal correction arithmetic unit 31.

In the above-described structure, in the steady-state difference correction unit 41, the difference signal between the detection signal Ga of the gap sensor 7*a* and the detection signal Gb of the gap sensor 7*b* is fed back to the signals Ga and Gb via the feedback gain multiplier 42 and integrator 43.

In this case, by properly setting the feedback gain K, the relative difference between the detection signals Ga and Gb can be reduced to zero, with little influence by sharp variations of the sensor signals.

At this time, each of the distribution coefficients m1 and m2 of the distribution coefficient multipliers 44*a* and 44*b* is set at "½", and feedback to the signals Ga and Gb is executed with equal distribution ratios. Thereby, as shown in FIG. 19, the corrected detection signals Gac and Gbc can be made to reach the neighborhood of the central value of the detection signals Ga and Gb. Specifically, for example, if the value of the detection signal Ga is 7 and the value of the detection signal Gb is 8, the value of the corrected detection signal Gac, Gbc can be made to reach 7.5.

As has been described above, after the relative difference between the two sensor signals Ga and Gb is corrected in advance, the corrected detection signals are delivered to the signal correction arithmetic unit 31. Thereby, as shown in FIG. 20, the variation of the output signal Gc, which occurs when the values of the weight coefficients $\alpha$ and $\beta$ are varied, can further be reduced.

The above-described signal correction arithmetic unit 31 is applicable to the structure of any one of the first to fourth embodiments.

In the above description of the embodiment, each of the values of the distribution coefficients m1 and m2 is set at "½" and equal feedback is executed, and thereby the corrected detection signals Gac and Gbc are made to reach the neighborhood of the central value of the detection signals Ga and Gb. Alternatively, for example, one of the distribution coefficients of the signals Ga and Gb, for instance, m1, may be set at 1, and the other distribution coefficient m2 may be set at 0. Thereby, the difference between both signals can be corrected in accordance with one of the sensor output values. In this case, correction is always made in a manner to approach one of the sensor output values. Therefore, in a case where noise of one of the sensors is obviously small or in a case where it is understood in advance that one of the sensor output values is approximately a true value, the corrected detection signal can be made to reach this sensor output value.

Besides, by setting the sum of the distribution coefficients m1 and m2 of the signals Ga and Gb at 1 and setting the values of the respective distribution coefficients m1 and m2 in the range of between 0 to 1, the value, to which the corrected detection value is to be brought, may be made to approach either of the sensor output values.

Sixth Embodiment

Next, a sixth embodiment of the present invention is described.

The sixth embodiment, like the fifth embodiment, relates to a pre-process of a sensor signal. The value of the feedback gain K is varied in accordance with the difference between the detection signal Ga and detection signal Gb.

Figure 21:
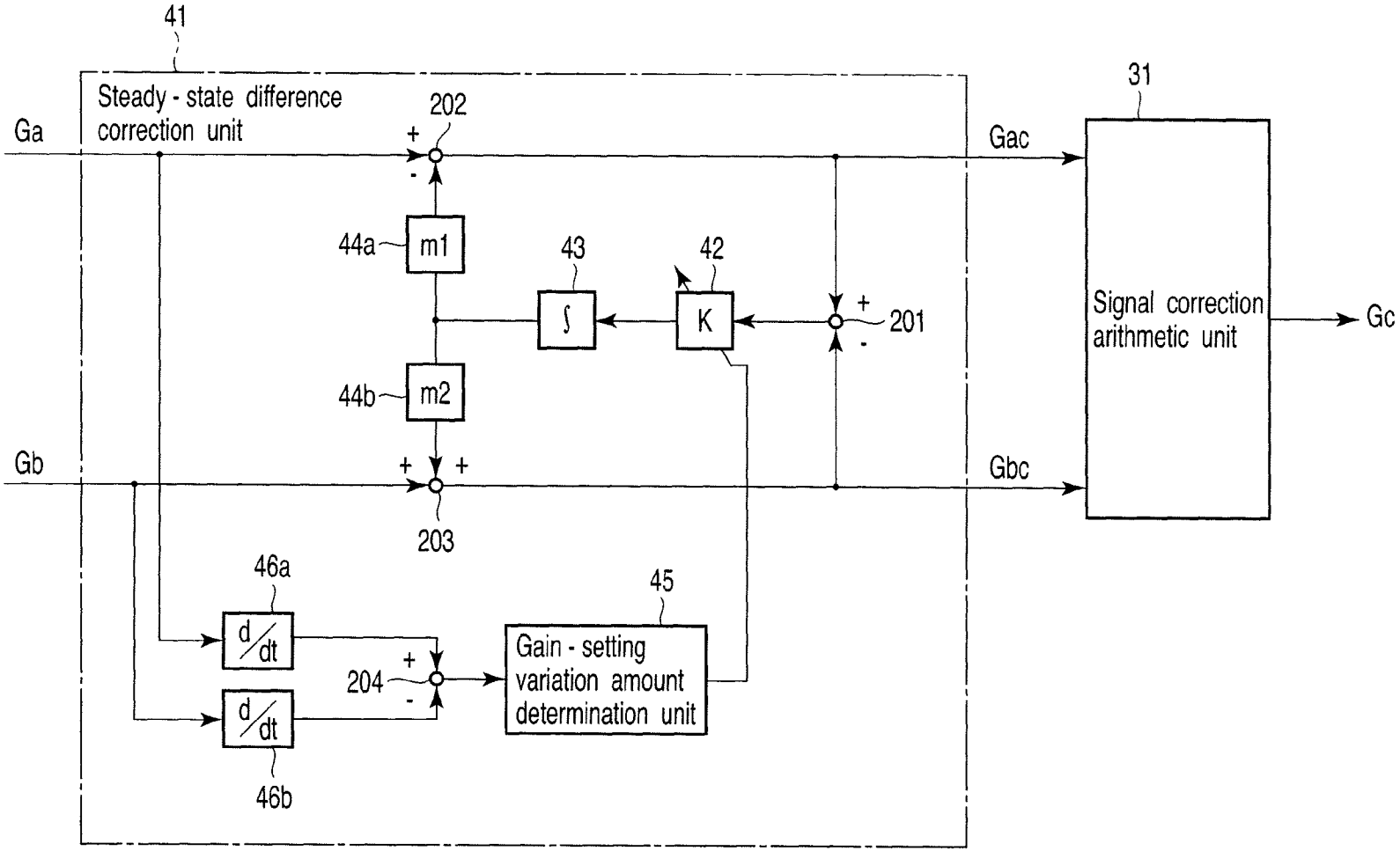
FIG. 21 is a block diagram showing the structure of a steady-state difference correction unit according to a sixth embodiment of the present invention.
Figure 22:
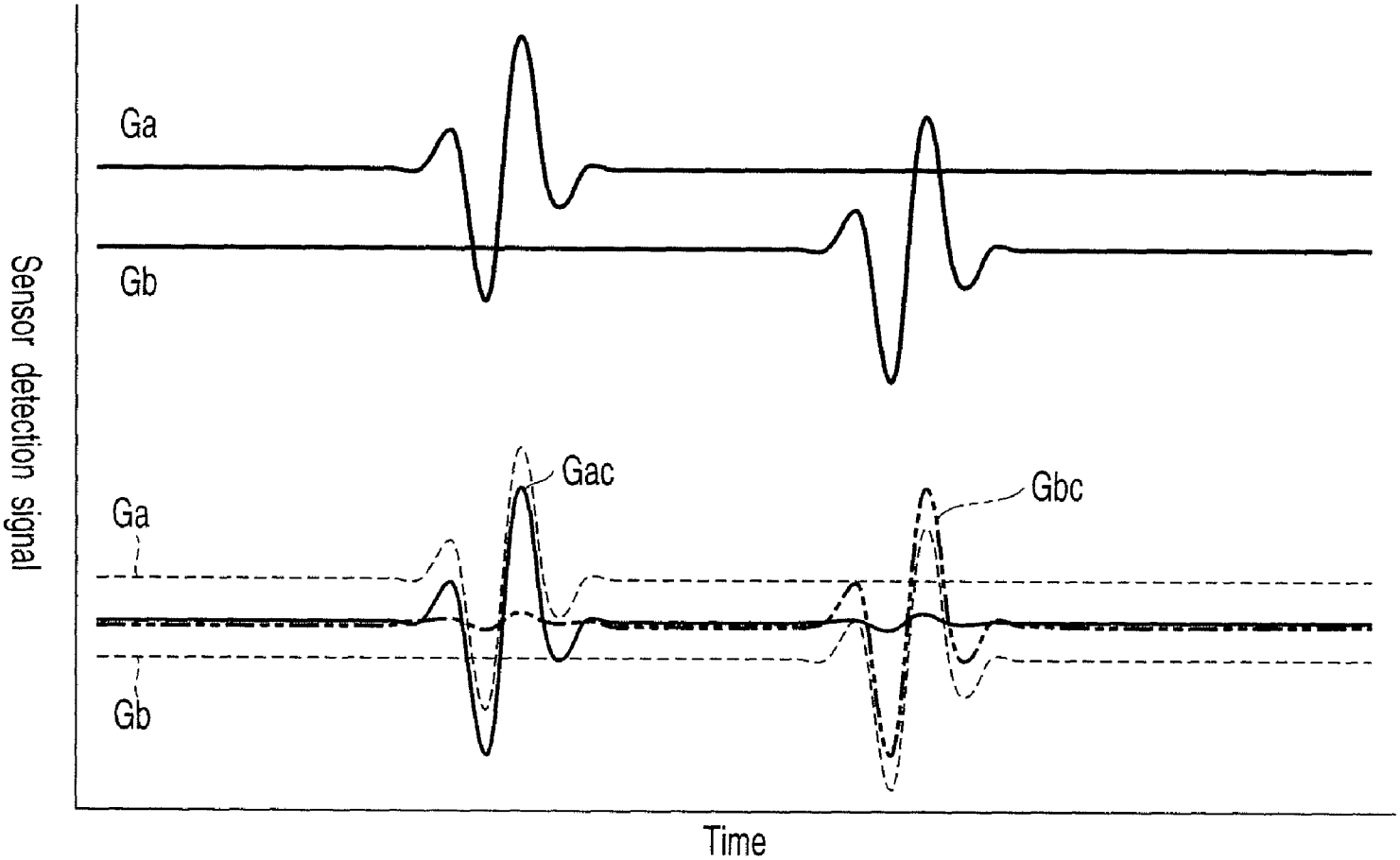
FIG. 22 is a graph showing response characteristics of respective signals in the steady-state difference correction unit in the sixth embodiment.

FIG. 21 is a block diagram showing the structure of a steady-state difference correction unit 41 according to the sixth embodiment of the invention. The structural parts common to those of the fifth embodiment shown in FIG. 18 are denoted by like reference numerals, and a description thereof is omitted here. FIG. 22 is a graph showing response characteristics of respective signals in the steady-state difference correction unit 41.

As shown in FIG. 21, the steady-state difference correction unit 41 is provided with differentiators 46*a* and 46*b*, a subtracter 204 and a gain-setting variation amount determination unit 45.

The differentiator 46*a* differentiates the detection signal Ga of the gap sensor 7*a*, and outputs the resultant signal to the subtracter 204. The differentiator 46*b* differentiates the detection signal Gb of the gap sensor 7*b*, and outputs the resultant signal to the subtracter 204.

The subtracter 204 calculates a difference (a difference between variation amounts) between the differential signal of the detection signal Ga and the differential signal of the detection signal Gb. The gain-setting variation amount determination unit 45 sets the value of the feedback gain K on the basis of the arithmetic result of the subtracter 204.

In the above-described structure, the detection signal Ga of the gap sensor 7*a* and the detection signal Gb of the gap sensor 7*b* are differentiated by the differentiators 46*a* and 46*b*, respectively. The subtracter 204 finds a difference between both signals, and delivers the difference signal to the gain-setting variation amount determination unit 45. On the basis of the difference signal, the gain-setting variation amount determination unit 45 sets the value of the feedback gain K.

For example, when the difference (the difference between variation amounts) between the differential signals of the signals Ga and Gb is greater than a predetermined value, this means that either of the signals is disturbed. Thus, the value of the feedback gain K is made less than a predetermined value. On other hand, when the difference (the difference between variation amounts) between the differential signals of the signals Ga and Gb is less than the predetermined value, the value of the feedback gain K is set at the predetermined value.

In this manner, by adjusting the value of the feedback gain K, a small disturbance, which occurs when a signal indicative of a disturbed response is fed back to a signal indicative of a smooth response, can be reduced. As a result, as shown in FIG. 22, smoother corrected detection signals Gac and Gbc can be obtained.

Figure 23:
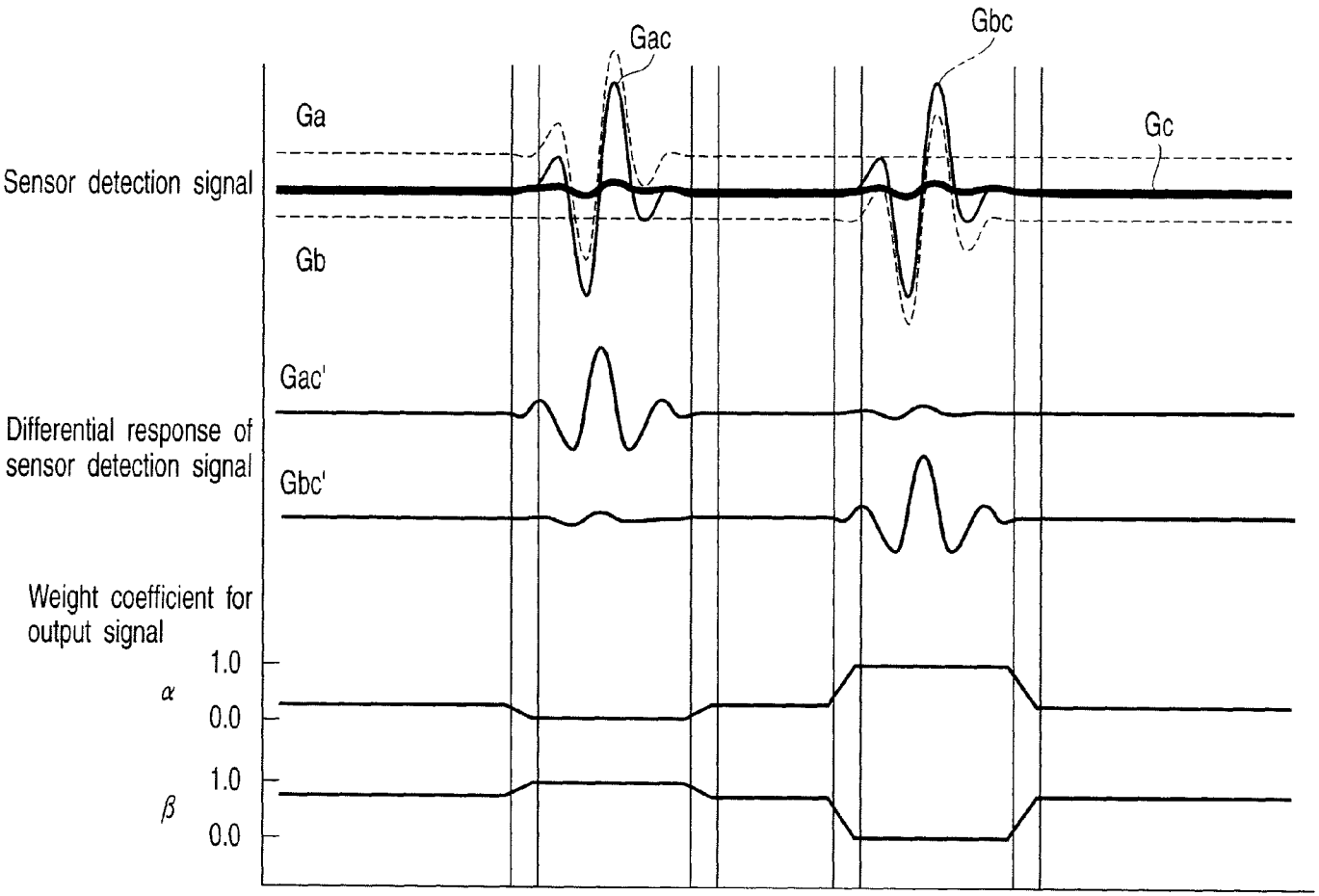
FIG. 23 is a graph showing response characteristics of respective signals in a signal correction arithmetic unit in the sixth embodiment.

By delivering these corrected detection signals Gac and Gbc to the signal correction arithmetic unit 31, a smoother response, as shown in FIG. 23, can be obtained. Therefore, the precision in magnetic control can be enhanced, and the car 4 can non-contactly be run and guided.

The above-described signal correction arithmetic unit 31 is applicable to the structure of any one of the first to fourth embodiments.

Seventh Embodiment

Next, a seventh embodiment of the present invention is described.

In the seventh embodiment, a structure for subjecting the detection signals to second-order differentiation is added to the structure of the sixth embodiment.

Figure 24:
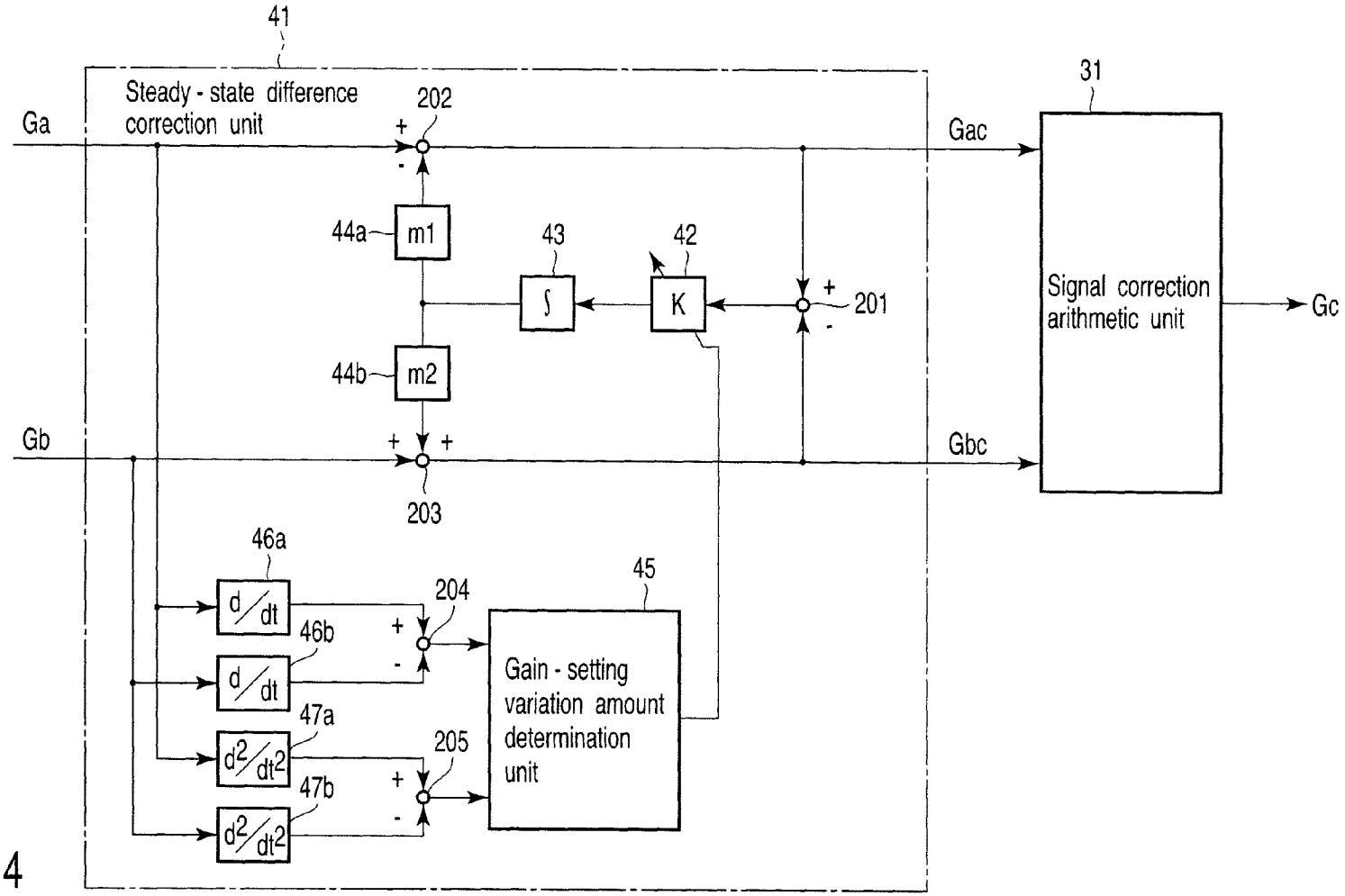
FIG. 24 is a block diagram showing the structure of a steady-state difference correction unit according to a seventh embodiment of the present invention.
Figure 25:
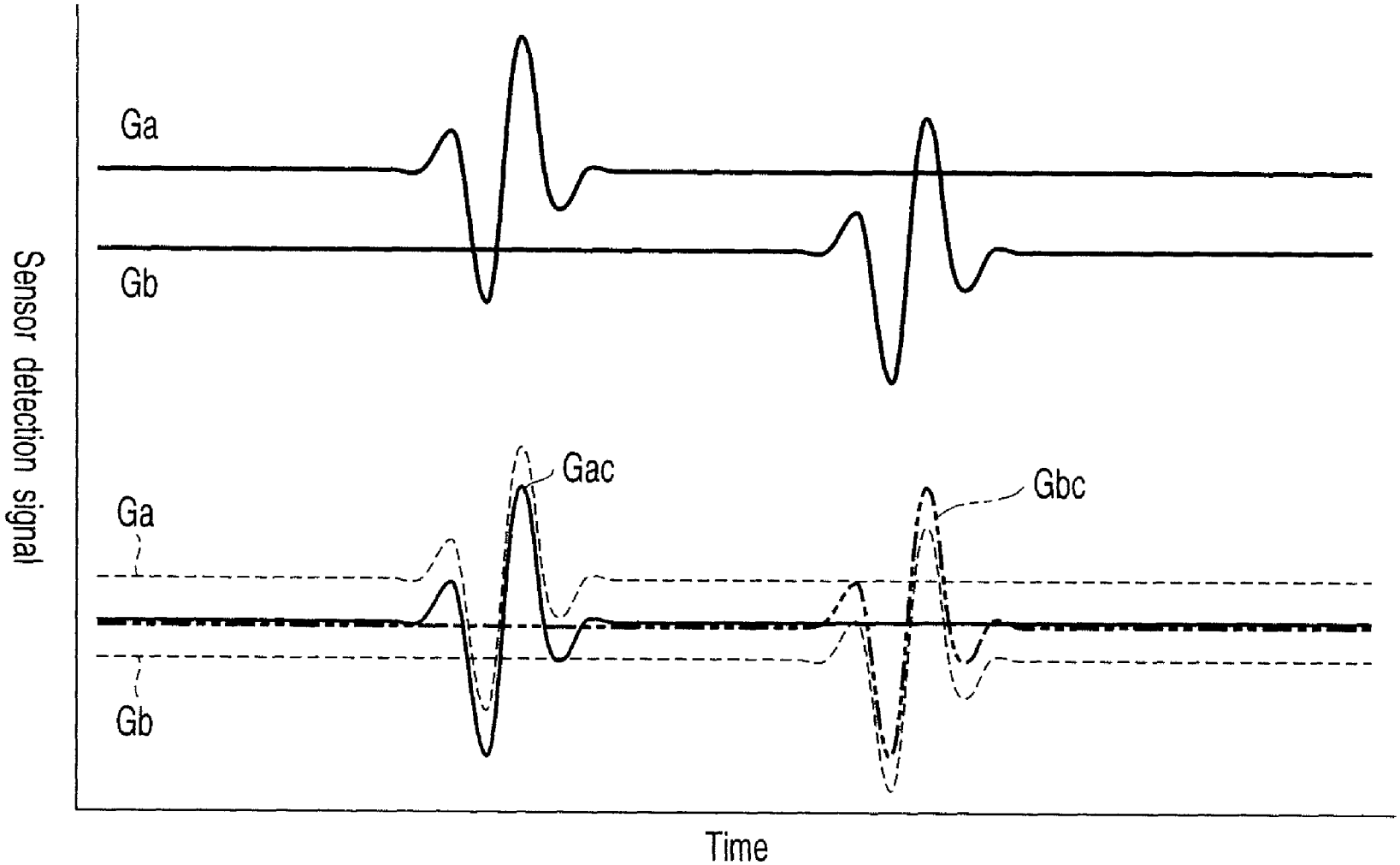
FIG. 25 is a graph showing response characteristics of respective signals in the steady-state difference correction unit in the seventh embodiment.

FIG. 24 is a block diagram showing the structure of a steady-state difference correction unit 41 according to the seventh embodiment of the invention. The structural parts common to those of the fifth embodiment shown in FIG. 18 are denoted by like reference numerals, and a description thereof is omitted here. FIG. 25 is a graph showing response characteristics of respective signals in the steady-state difference correction unit 41.

As shown in FIG. 24, the steady-state difference correction unit 41 is provided with differentiators 46*a* and 46*b*, a subtracter 204, second-order differentiators 47*a* and 47*b*, a subtracter 205, and a gain-setting variation amount determination unit 45.

The differentiator 46*a* differentiates the detection signal Ga of the gap sensor 7*a*, and outputs the resultant signal to the subtracter 204. The differentiator 46*b* differentiates the detection signal Gb of the gap sensor 7*b*, and outputs the resultant signal to the subtracter 204. The subtracter 204 calculates a difference (a difference between variation amounts) between the differential signal of the detection signal Ga and the differential signal of the detection signal Gb.

The differentiator 47*a* second-order differentiates the detection signal Ga of the gap sensor 7*a*, and outputs the resultant signal to the subtracter 205. The differentiator 47*b* second-order differentiates the detection signal Gb of the gap sensor 7*b*, and outputs the resultant signal to the subtracter 205.

The subtracter 205 calculates a difference (a difference between variation amounts) between the second-order differential signal of the detection signal Ga and the second-order differential signal of the detection signal Gb. The gain-setting variation amount determination unit 45 sets the value of the feedback gain K on the basis of the arithmetic result of the subtracter 204 and the arithmetic result of the subtracter 205.

In the above-described structure, the detection signal Ga of the gap sensor 7*a* and the detection signal Gb of the gap sensor 7*b* are differentiated by the differentiators 46*a* and 46*b*, respectively. The subtracter 204 finds a difference between both signals, and delivers the difference signal to the gain-setting variation amount determination unit 45.

On the other hand, the detection signal Ga of the gap sensor 7*a* and the detection signal Gb of the gap sensor 7*b* are second-order differentiated by the second-order differentiators 47*a* and 47*b*, respectively. The subtracter 205 finds a difference between both signals, and delivers the difference signal to the gain-setting variation amount determination unit 45. On the basis of both difference signals, the gain-setting variation amount determination unit 45 sets the value of the feedback gain K.

When one of the difference between the first-order differential signals of Ga and Gb and the difference between the second-order differential signals of Ga and Gb is relatively large, the value of the difference feedback gain K is made less than a predetermined value. On other hand, when both the difference between the first-order differential signals of Ga and Gb and the difference between the second-order differential signals of Ga and Gb are relatively small, the value of the difference feedback gain K is set at the predetermined value.

In this manner, by adjusting the value of the feedback gain K, when the detection signal Ga, Gb takes a ridge shape or a dip shape at the joint 2*c* of the guide rail 2, it becomes possible to prevent the first-order differential value from temporarily decreasing near the apex of the ridge shape or dip shape, and to prevent the feedback gain K from increasing.

Figure 26:
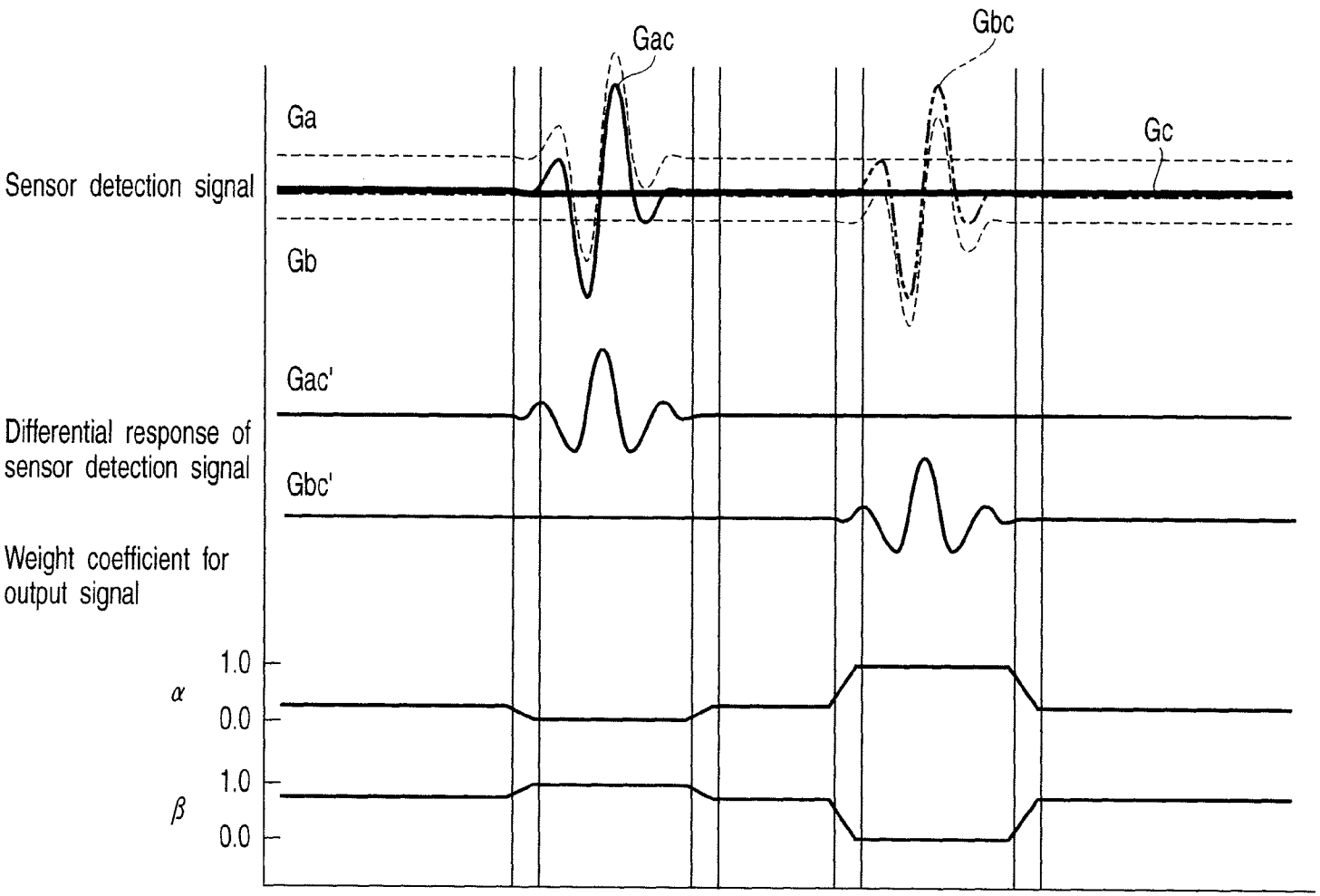
FIG. 26 is a graph showing response characteristics of respective signals in a signal correction arithmetic unit in the seventh embodiment.

As a result, as shown in FIG. 25, an output signal Gc, which is hardly affected by the disturbance of the mutual detection signals, can be obtained. In addition, by inputting the detection signals Ga and Gb to the signal correction arithmetic unit 31, a smoother response, as shown in FIG. 26, can be obtained.

The above-described signal correction arithmetic unit 31 is applicable to the structure of any one of the first to fourth embodiments.

Eighth Embodiment

Next, an eighth embodiment of the present invention is described.

In the fifth to seventh embodiments, the difference signal between the detection signal Ga and the detection Gb is fed back. By contrast, in the eighth embodiment, an average value of the detection signal Ga and detection signal Gb is calculated, and a difference signal between the calculated average value and each of the signals Ga and Gb is fed back.

Figure 27:
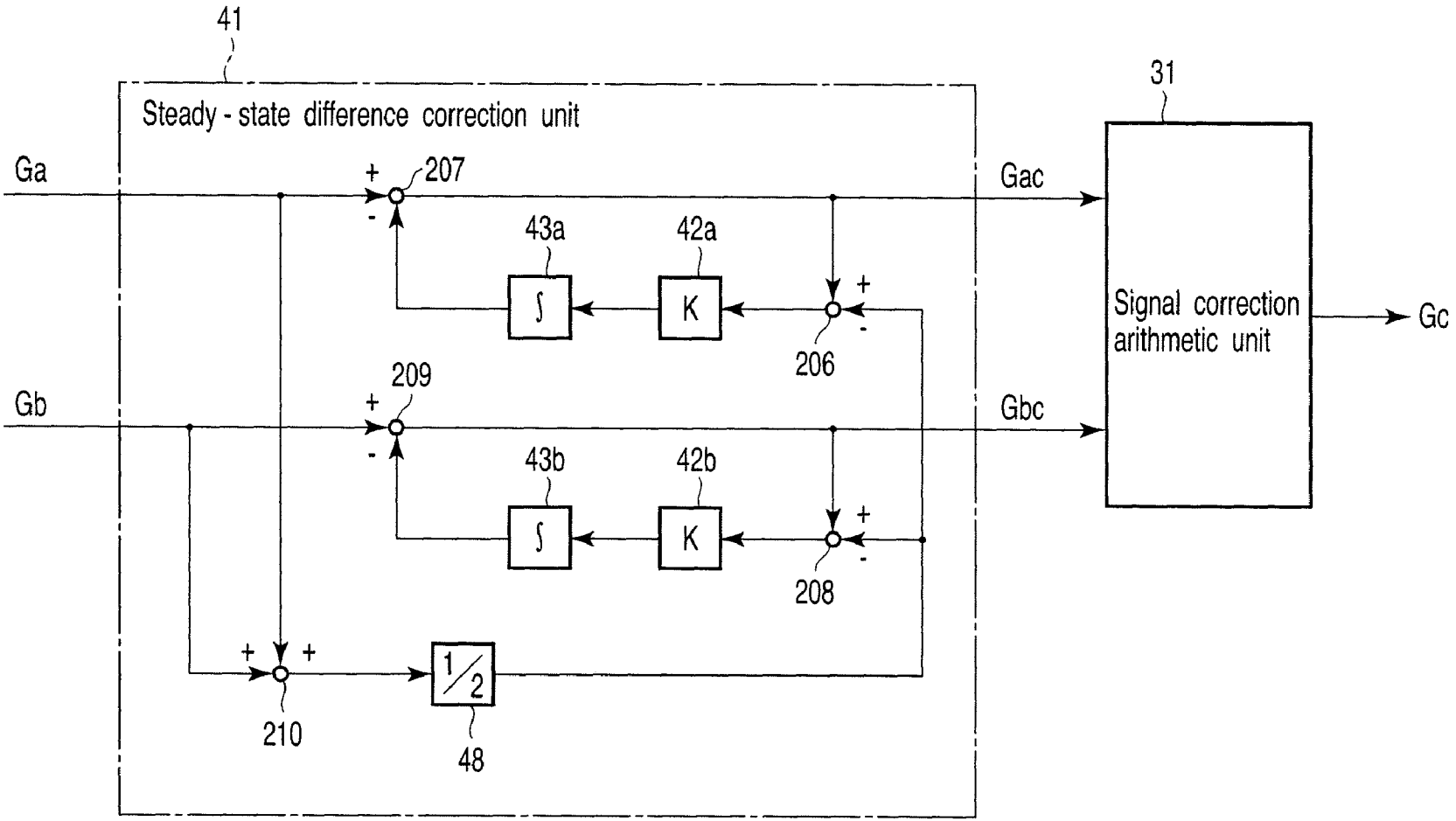
FIG. 27 is a block diagram showing the structure of a steady-state difference correction unit according to an eighth embodiment of the present invention.

FIG. 27 is a block diagram showing the structure of a steady-state difference correction unit 41 according to the eighth embodiment of the invention.

The steady-state difference correction unit 41 includes, as a structure associated with the detection signal Ga of the gap sensor 7*a*, a subtracter 206, a feedback gain multiplier 42*a*, an integrator 43*a* and a subtracter 207. In addition, the steady-state difference correction unit 41 includes, as a structure associated with the detection signal Gb of the gap sensor 7*b*, a subtracter 208, a feedback gain multiplier 42*b*, an integrator 43*b* and a subtracter 209.

Further, the steady-state difference correction unit 41 is provided with an adder 210 and a ½ arithmetic unit 48, as a structure for averaging the detection signal Ga and detection signal Gb.

The subtracter 206 calculates a difference between the detection signal Ga of the gap sensor 7*a* and an output signal (an average signal of Ga and Gb) of the ½ arithmetic unit 48. The feedback gain multiplier 42*a* multiplies the difference signal, which is output from the subtracter 206, by a predetermined feedback gain K, and outputs the resultant signal to the integrator 43*a*. The integrator 43*a* time-integrates the output signal of the feedback gain multiplier 42*a*, and feeds the resultant signal back to the subtracter 207.

The subtracter 207 calculates a difference between the detection signal Ga, which is input to the steady-state difference correction unit 41, and the feedback signal, and outputs the difference signal as a corrected detection signal Gac to the signal correction arithmetic unit 31.

The subtracter 208 calculates a difference between the detection signal Gb of the gap sensor 7*b* and the output signal (the average signal of Ga and Gb) of the ½ arithmetic unit 48. The feedback gain multiplier 42*b* multiplies the difference signal, which is output from the subtracter 208, by a predetermined feedback gain K, and outputs the resultant signal to the integrator 43*b*. The integrator 43*b* time-integrates the output signal of the feedback gain multiplier 42*b*, and feeds the resultant signal back to the subtracter 209.

The subtracter 209 calculates a difference between the detection signal Gb, which is input to the steady-state difference correction unit 41, and the feedback signal, and outputs the difference signal as a corrected detection signal Gbc to the signal correction arithmetic unit 31.

The adder 210 adds the detection signal Ga of the gap sensor 7*a* and the detection signal Gb of the gap sensor 7*b*. The ½ arithmetic unit 48 generates an average value signal in which the added value of the detection signals Ga and Gb, which is obtained by the adder 210, is halved.

In the above-described structure, the average value of the detection signals Ga and Gb is calculated, and the average value signal is delivered to each of the subtracters 206 and 208. Thereby, a signal, which is obtained by multiplying the difference signal between this average value signal and the detection signal Ga by the predetermined feedback gain K, is fed back, and a corrected detection signal Gac is produced. Similarly, a signal, which is obtained by multiplying the difference signal between this average value signal and the detection signal Gb by the predetermined feedback gain K, is fed back, and a corrected detection signal Gbc is produced.

In this manner, the feedback gains K, which are applied to the signals Ga and Gb, are individually set, and the speed of convergence of each of the signals Ga and Gb can arbitrarily be varied. Therefore, in the case where the state of disturbance of signals is different between gap sensors, the response can be adjusted in accordance with the characteristics of the respective sensors.

In the meantime, as in the sixth and seventh embodiments, it is possible to adopt such a structure that the feedback gain K is varied.

Ninth Embodiment

Figure 28:
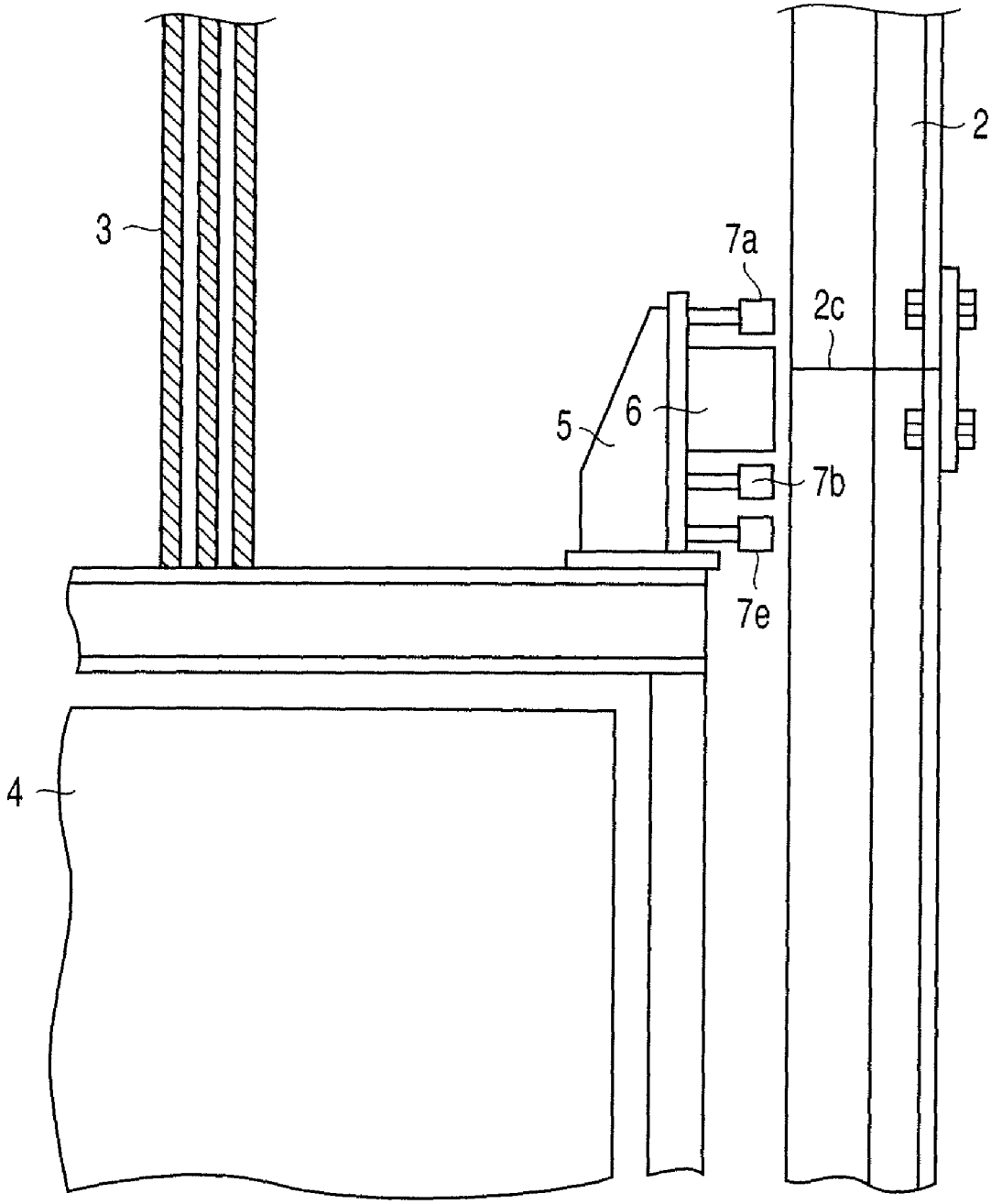
FIG. 28 shows an example of arrangement of three gap sensors according to a ninth embodiment of the present invention.

In the preceding embodiments, the description is directed to the case in which two gap sensors are disposed with respect to one direction for detection. The following description is directed to a case in which three gap sensors (7*a*, 7*b* and 7*e*) are disposed with respect to one direction for detection, as shown in FIG. 28. The gap sensors 7*a*, 7*b* and 7*e* are arranged in the direction of movement of the car 4, and are opposed to the same surface of the guide rail 2.

Figure 29:
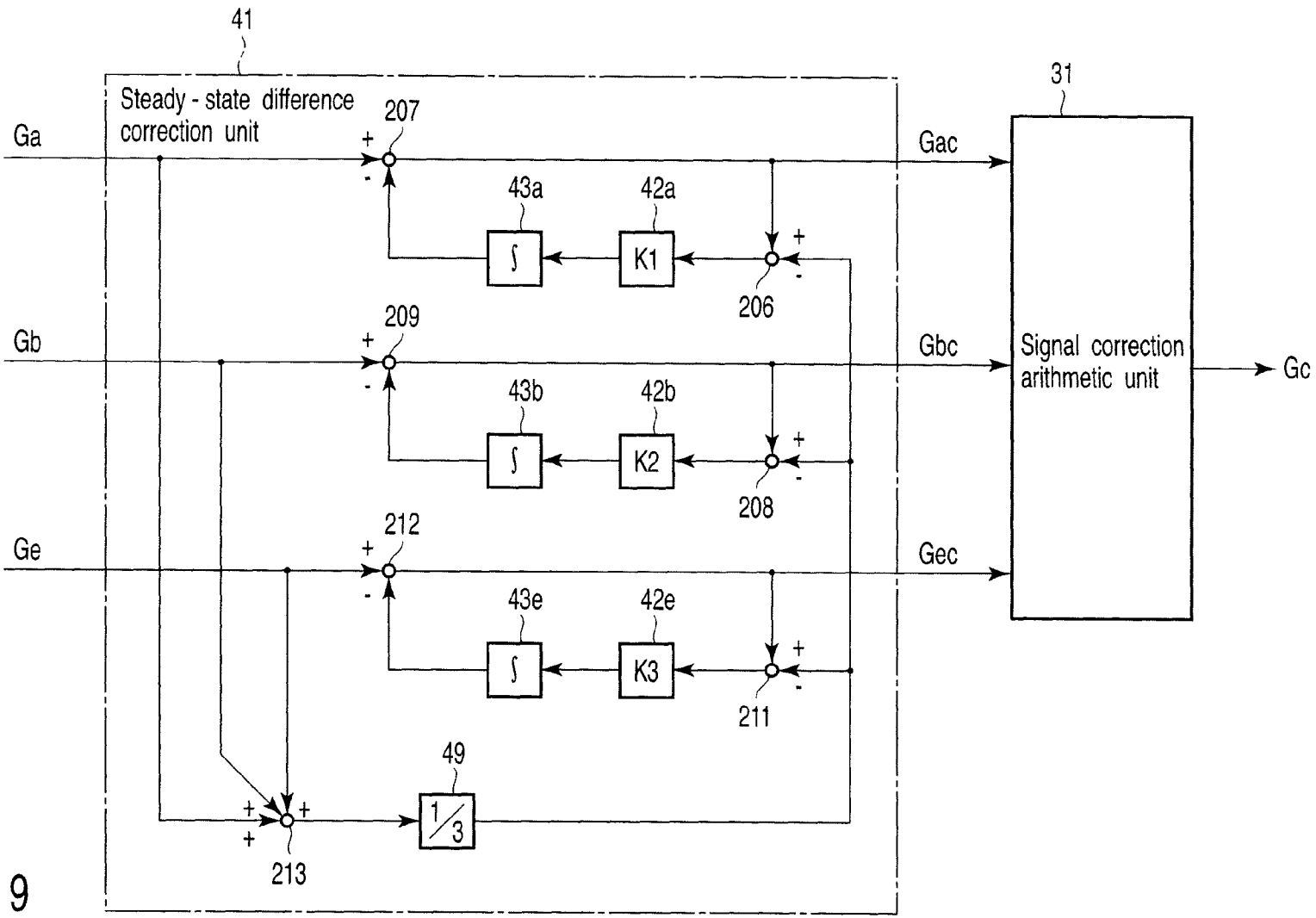
FIG. 29 is a block diagram showing the structure of a steady-state difference correction unit according to the ninth embodiment.

FIG. 29 is a block diagram showing the structure of a steady-state difference correction unit 41 according to the ninth embodiment of the invention. In this embodiment, the steady-state difference correction unit 41 shown in FIG. 25 is configured to have a three-stage structure.

Figure 30:
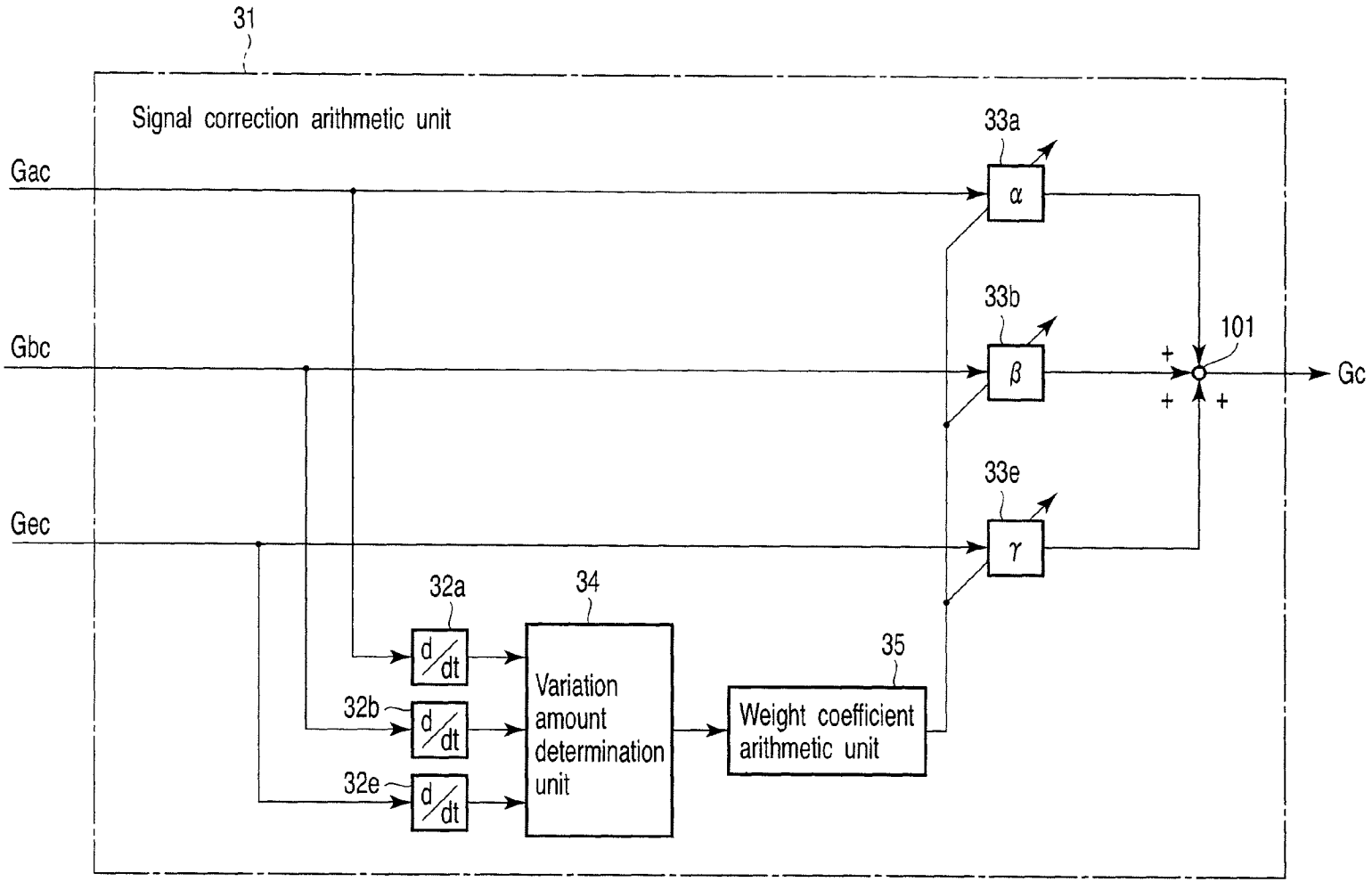
FIG. 30 is a block diagram showing a structure of a signal correction arithmetic unit in the ninth embodiment.
Figure 31:
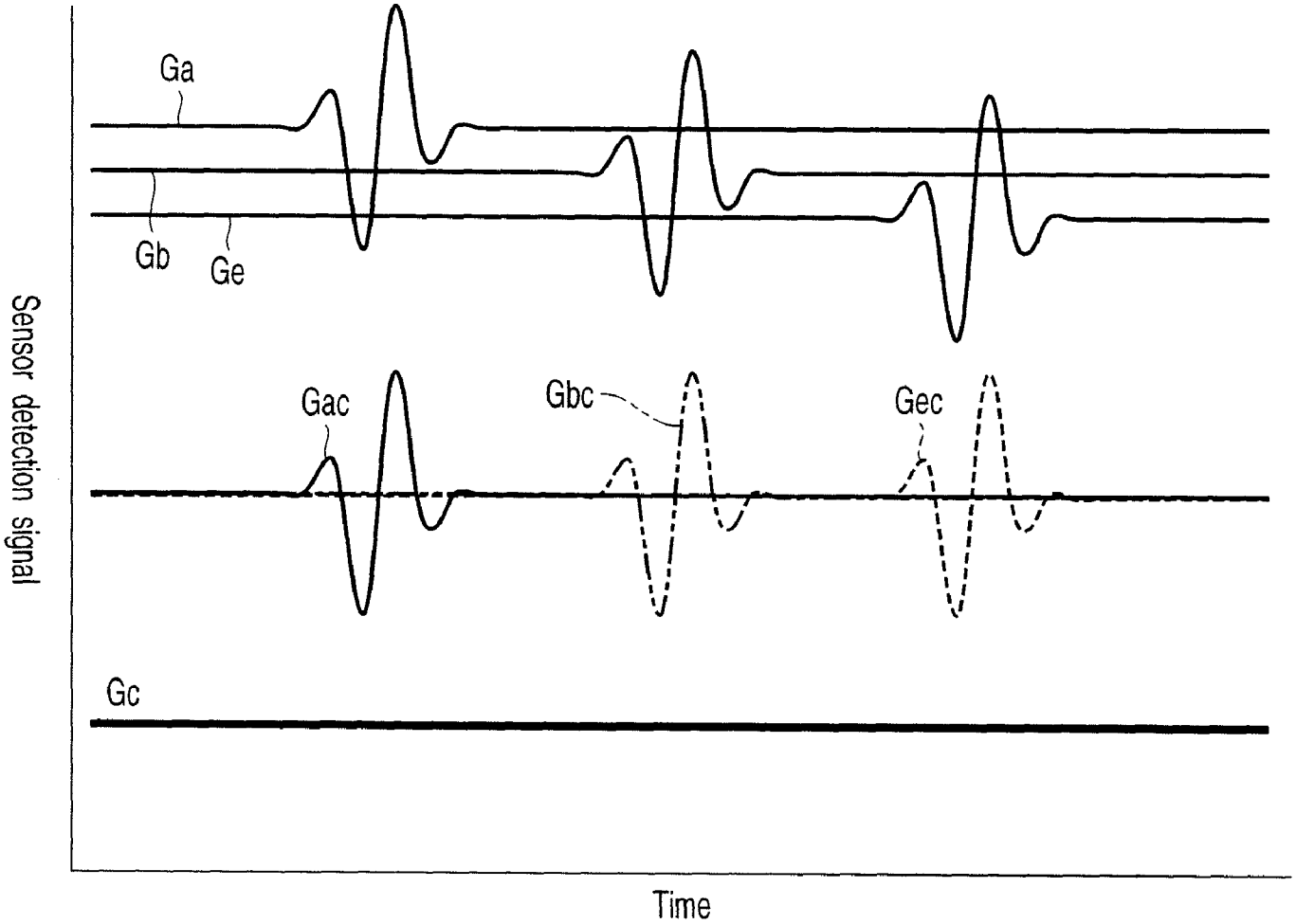
FIG. 31 is a graph showing response characteristics of respective signals in the signal correction arithmetic unit in the ninth embodiment.

FIG. 30 is a block diagram showing the structure of a signal correction arithmetic unit 31 in the ninth embodiment. In this embodiment, the signal correction arithmetic unit 31 shown in FIG. 10 is configured to have a three-stage structure. FIG. 31 is a graph showing response characteristics of respective signals in the signal correction arithmetic unit 31.

As shown in FIG. 29, the steady-state difference correction unit 41 includes, as a structure associated with the detection signal Ga of the gap sensor 7*a*, a subtracter 206, a feedback gain multiplier 42*a*, an integrator 43*a* and a subtracter 207. In addition, the steady-state difference correction unit 41 includes, as a structure associated with the detection signal Gb of the gap sensor 7*b*, a subtracter 208, a feedback gain multiplier 42*b*, an integrator 43*b* and a subtracter 209.

Further, the steady-state difference correction unit 41 includes, as a structure associated with the detection signal Ge of the gap sensor 7*e*, a subtracter 211, a feedback gain multiplier 42*e*, an integrator 43*e* and a subtracter 212. Besides, the steady-state difference correction unit 41 is provided with an adder 213 and a ⅓ arithmetic unit 49, as a structure for averaging the detection signal Ga, detection signal Gb and detection signal Ge.

The subtracter 206 calculates a difference between the detection signal Ga of the gap sensor 7*a* and an output signal (an average signal of Ga, Gb and Ge) of the ⅓ arithmetic unit 49. The feedback gain multiplier 42*a* multiplies the difference signal, which is output from the subtracter 206, by a predetermined feedback gain K, and outputs the resultant signal to the integrator 43*a*. The integrator 43*a* time-integrates the output signal of the feedback gain multiplier 42*a*, and feeds the resultant signal back to the subtracter 207.

The subtracter 207 calculates a difference between the detection signal Ga, which is input to the steady-state difference correction unit 41, and the feedback signal, and outputs the difference signal as a corrected detection signal Gac to the signal correction arithmetic unit 31.

The subtracter 208 calculates a difference between the detection signal Gb of the gap sensor 7*b* and the output signal (the average signal of Ga, Gb and Ge) of the ⅓ arithmetic unit 49. The feedback gain multiplier 42*b* multiplies the difference signal, which is output from the subtracter 208, by a predetermined feedback gain K, and outputs the resultant signal to the integrator 43*b*. The integrator 43*b* time-integrates the output signal of the feedback gain multiplier 42*b*, and feeds the resultant signal back to the subtracter 209.

The subtracter 209 calculates a difference between the detection signal Gb, which is input to the steady-state difference correction unit 41, and the feedback signal, and outputs the difference signal as a corrected detection signal Gbc to the signal correction arithmetic unit 31.

The subtracter 211 calculates a difference between the detection signal Ge of the gap sensor 7*e* and the output signal (the average signal of Ga, Gb and Ge) of the ⅓ arithmetic unit 49. The feedback gain multiplier 42*e* multiplies the difference signal, which is output from the subtracter 211, by a predetermined feedback gain K, and outputs the resultant signal to the integrator 43*e*. The integrator 43*e* time-integrates the output signal of the feedback gain multiplier 42*e*, and feeds the resultant signal back to the subtracter 212.

The subtracter 212 calculates a difference between the detection signal Ge, which is input to the steady-state difference correction unit 41, and the feedback signal, and outputs the difference signal as a corrected detection signal Gec to the signal correction arithmetic unit 31.

The adder 213 adds the detection signal Ga of the gap sensor 7*a*, the detection signal Gb of the gap sensor 7*b* and the detection signal Ge of the gap sensor 7*e*. The ⅓ arithmetic unit 49 generates an average value signal in which the added value of the detection signals Ga, Gb and Ge, which is obtained by the adder 213, is divided by 3.

In the above-described structure, the average value of the detection signals Ga, Gb and Ge is calculated, and the average value signal is delivered to each of the subtracters 206, 208 and 211. Thereby, a signal, which is obtained by multiplying the difference signal between this average value signal and the detection signal Ga by the predetermined feedback gain K, is fed back, and a corrected detection signal Gac is produced.

Similarly, a signal, which is obtained by multiplying the difference signal between this average value signal and the detection signal Gb by the predetermined feedback gain K, is fed back, and a corrected detection signal Gbc is produced. Further, a signal, which is obtained by multiplying the difference signal between this average value signal and the detection signal Ge by the predetermined feedback gain K, is fed back, and a corrected detection signal Gbe is produced.

In this manner, with use of the three detection signals Ga, Gb and Ge, the differences between these signals and the average value thereof are fed back. Thereby, the difference of each signal can be corrected in a manner to approach the neighborhood of the average value of all sensors.

The corrected detection signals Gac, Gbc and Gec are delivered to the signal correction arithmetic unit 31. In this case, as shown in FIG. 30, in the signal correction arithmetic unit 31, the differentiated results of the corrected detection signals Gac, Gbc and Gec are compared, and the values of weight coefficients α, β and γ are adjusted so that their sum becomes 1. Thereby, as shown in FIG. 31, a smoother output signal Gc can be obtained. Therefore, magnetic control with higher precision can be executed, and the car 4 can stably be run.

In the signal correction arithmetic unit 31 shown in FIG. 30, the values of the weight coefficients α, β and γ are adjusted on the basis of the differential signals of the corrected detection signals Gac, Gbc and Gec. However, in usual cases, when three or more gap sensors are present, the signal of only one of the sensors is disturbed at the joint 2*c* of the guide rail 2 at a certain time point, and the signals of the other two sensors produce smooth responses.

Figure 32:
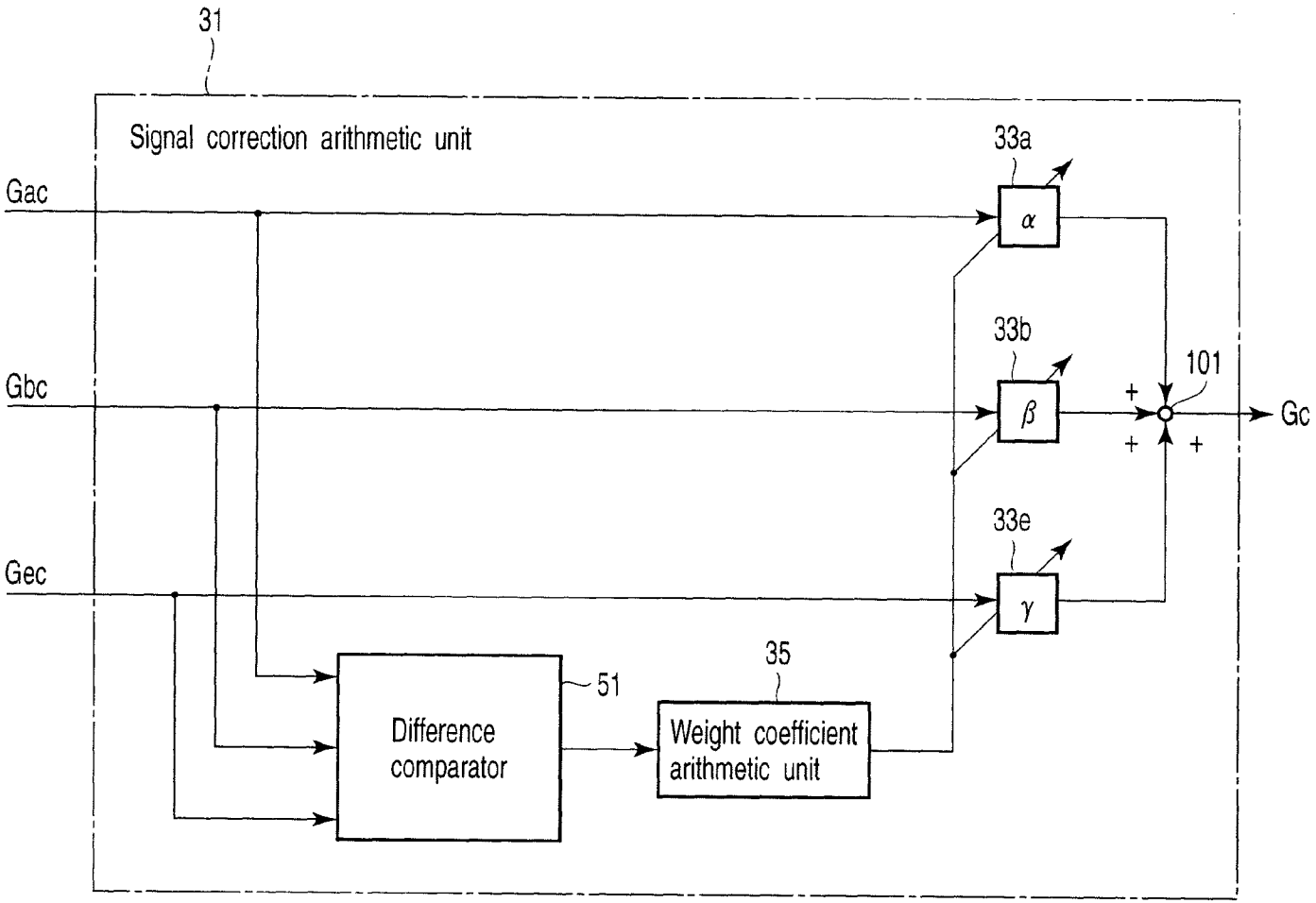
FIG. 32 is a block diagram showing another structure of the signal correction arithmetic unit in the ninth embodiment.

Thus, as shown in FIG. 32, a difference comparator 51 may be used, and the weight coefficients of those two of the three corrected detection signals Gac, Gbc and Gec, which have mutually close values, may be increased, and the weight coefficient of a signal having a remotest value may be decreased. Thereby, a smooth output signal Gc can be obtained.

Alternatively, instead of comparing the corrected detection signals Gac, Gbc and Gec themselves, the differential signals of these corrected detection signals may be compared, and the weight coefficients of two signals having mutually close values may be increased.

Such a structure may be adopted that the detection signals Ga, Gb and Gc, which are not corrected by the steady-state correction unit 41, may directly be input to the signal correction arithmetic unit 31 shown in FIG. 30 or FIG. 32.

Tenth Embodiment

Next, a tenth embodiment of the present invention is described.

The above-described ninth embodiment shows the example using three gap sensors. Alternatively, a greater number of gap sensors may be used with respect to one direction for detection. In this case, the same process can be executed by configuring the steady-state difference correction unit 41 and the signal correction arithmetic unit 31, as shown in FIG. 33 and FIG. 34.

Figure 33:
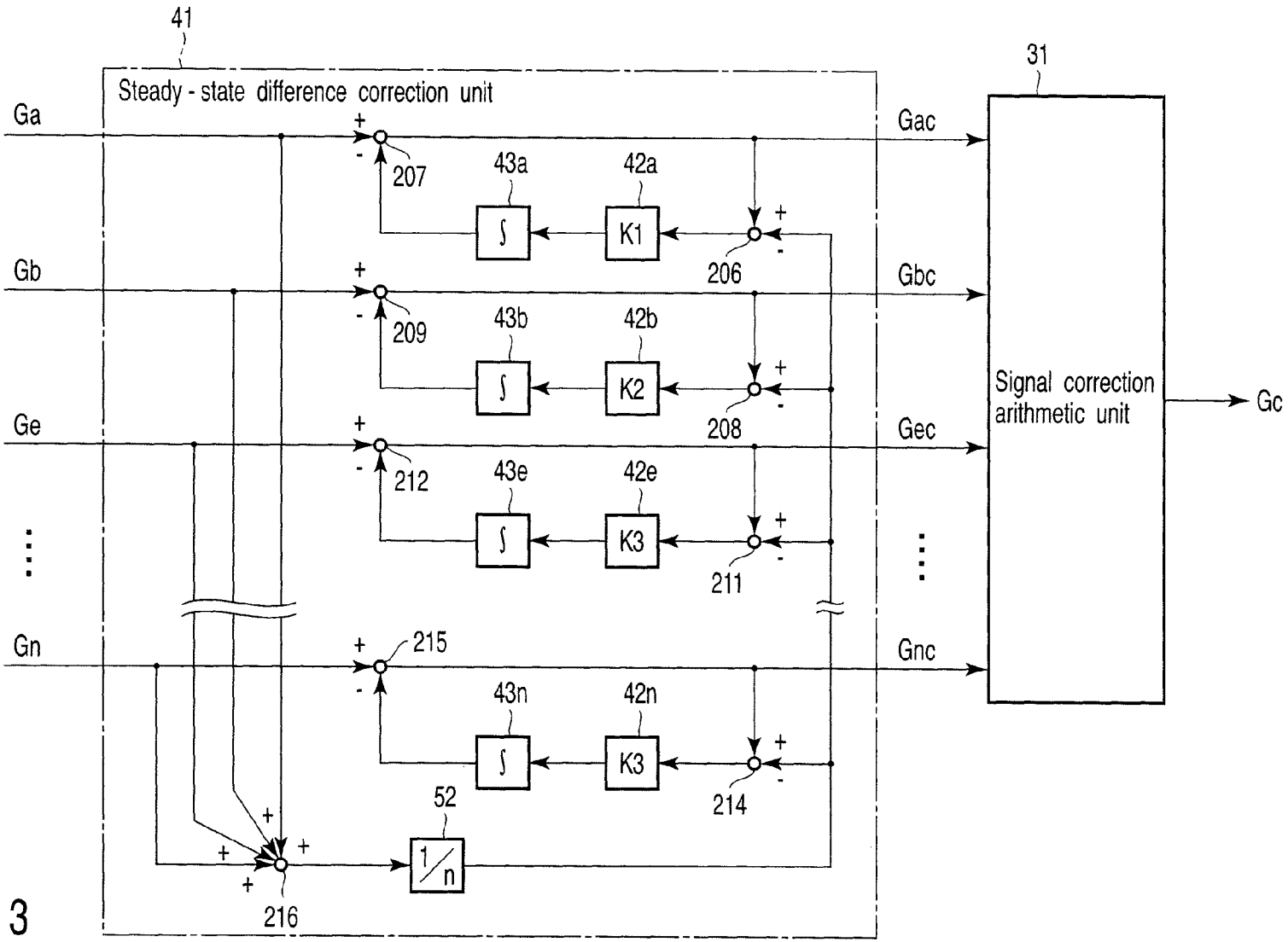
FIG. 33 is a block diagram showing the structure of a steady-state difference correction unit according to a tenth embodiment of the invention, in a case where an n-number of gap sensors are used.
Figure 34:
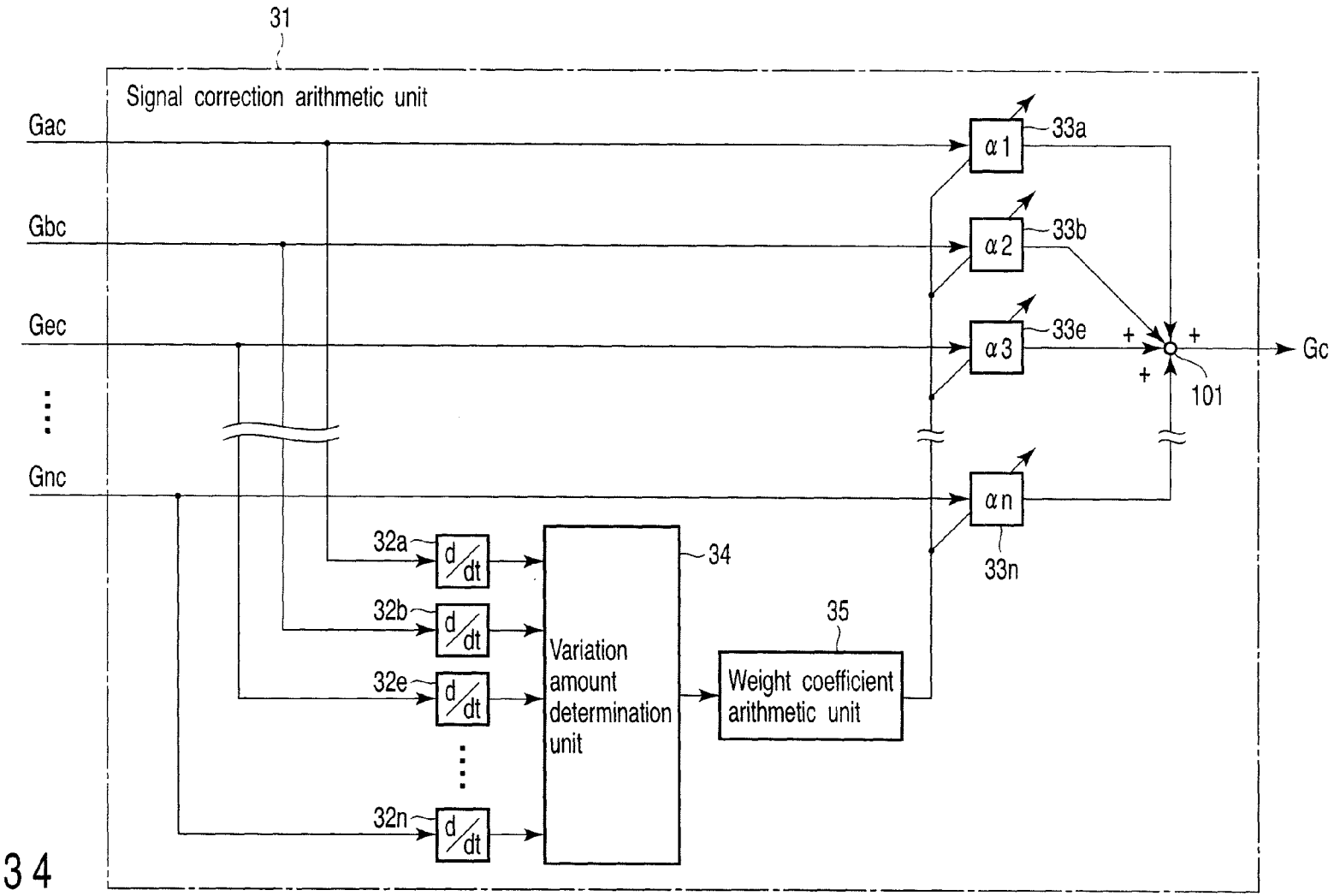
FIG. 34 is a block diagram showing the structure of a signal correction arithmetic unit according to the tenth embodiment of the invention, in a case where an n-number of gap sensors are used.

FIG. 33 is a block diagram showing the structure of a steady-state difference correction unit 41 according to the tenth embodiment of the invention, in a case where an n-number of gap sensors are used. In this embodiment, the steady-state difference correction unit 41 shown in FIG. 29 is configured to have an n-stage (n>3) structure. In FIG. 33, Gn denotes a detection signal of an n-th gap sensor (not shown), and Gnc denotes a corrected detection signal of the detection signal Gn.

The steady-state difference correction unit 41 includes, as a structure associated with the detection signal Gn of an n-th gap sensor, a subtracter 214, a feedback gain multiplier 42*n*, an integrator 43*n* and a subtracter 215. Besides, the steady-state difference correction unit 41 is provided with an adder 216 and a 1/n arithmetic unit 52, as a structure for averaging the detection signals Ga, Gb, Ge, . . . , Gn.

The subtracter 214 calculates a difference between the detection signal Gn of the n-th gap sensor (not shown) and an output signal (an average signal of Ga, Gb, Ge, . . . , Gn) of the 1/n arithmetic unit 52. The feedback gain multiplier 42*n* multiplies the difference signal, which is output from the subtracter 214, by a predetermined feedback gain K, and outputs the resultant signal to the integrator 43*n*. The integrator 43*n* time-integrates the output signal of the feedback gain multiplier 42*n*, and feeds the resultant signal back to the subtracter 215.

The subtracter 215 calculates a difference between the detection signal Gn, which is input to the steady-state difference correction unit 41, and the feedback signal, and outputs the difference signal as a corrected detection signal Gnc to the signal correction arithmetic unit 31.

The adder 216 adds the detection signals Ga, Gb, Ge, . . . , Gn. The 1/n arithmetic unit 52 generates an average value signal in which the added value of the detection signals Ga, Gb, Ge, . . . , Gn, which is obtained by the adder 216, is divided by n.

FIG. 34 is a block diagram showing the structure of a signal correction arithmetic unit 31 in a case where an n-number of gap sensors are used. In the structure shown in FIG. 34, the signal correction arithmetic unit 31 shown in FIG. 30 is configured to have an n-stage (n>3) structure. In FIG. 34, reference numeral 32*n* denotes a differentiator which differentiates the corrected detection signal Gnc of the n-th gap sensor (not shown).

By the above-described structure, with the increase in the number of gap sensors, a smoother output signal Gc can easily be obtained.

In the structure of the signal correction arithmetic unit 31, like the signal correction arithmetic unit 31 shown in FIG. 32, use may be made of the difference comparator 51 for comparing the differences of the signals.

Such a structure may be adopted that the detection signals Ga, Gb, Ge, . . . , Gn, which are not corrected by the steady-state correction unit 41, may directly be input to the signal correction arithmetic unit 31.

In the above-described embodiments, the signal processing of the gap sensors, which are provided with respect to one direction for detection, has been described. However, the same applies to the signal processing of the gap sensors (7*c*, 7*d* in FIG. 2) which are provided with respect to other directions for detection.

In each of the above-described embodiments, the method of signal processing of gap sensors has been described by exemplifying the magnetic guide apparatus provided in the car of the elevator. However, the magnetic guide apparatus of the present invention can be applied not only to the elevator, but also to any kind of moving body which is non-contactly supported by utilizing magnetism. In this case, by executing the same signal processing as described above, unnecessary disturbance, which is superimposed on the detection signal of the gap sensor, can be reduced, and smooth running and guiding can be realized.

In summary, the present invention is not limited directly to the above-described embodiments. In practice, the structural elements can be modified and embodied without departing from the spirit of the invention. Various modes can be made by properly combining the structural elements disclosed in the embodiments. For example, some structural elements may be omitted from all the structural elements disclosed in the embodiments. Furthermore, structural elements in different embodiments may properly be combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A magnetic guide apparatus comprising:

a guide rail formed of a ferromagnetic body;

a moving body which moves along the guide rail;

a magnet unit which is disposed on a part of the moving body, which is opposed to the guide rail, and supports, by an action of magnetic force, the moving body in a state in which the moving body is out of contact with the guide rail;

at least two gap sensors which are disposed with a predetermined interval in a direction of movement of the moving body, and detect a gap between the magnet unit and the guide rail;

a signal correction unit which determines variation amounts of detection signals which are output from the gap sensors, relatively varies weight coefficients for the respective detection signals on the basis of the variation amounts, and outputs, as a signal for magnetic control, a signal which is obtained by adding the detection signals which are multiplied by the weight coefficients; and a control unit which controls the magnetic force of the magnet unit on the basis of the signal for magnetic control, which is output from the signal correction unit.

2. The magnetic guide apparatus according to claim 1, wherein the signal correction unit increases the weight coefficient for one of the detection signals, which has a smaller variation amount, and decreases the weight coefficient for the other of the detection signals, which has a larger variation amount.

3. The magnetic guide apparatus according to claim 1, wherein the signal correction unit continuously varies the weight coefficient during a predetermined time period.

4. The magnetic guide apparatus according to claim 1, wherein the signal correction unit sets an upper limit to a variation ratio of the weight coefficient.

5. The magnetic guide apparatus according to claim 1, wherein the signal correction unit includes an averaging unit which generates an average value signal in which the detection signals that are output from the gap sensors are averaged, and the signal correction unit outputs, as a signal for magnetic control, a signal which is obtained by multiplying the detection signals, including the average value signal generated by the averaging unit, by weight coefficients, and adding the signals obtained by the multiplication.

6. The magnetic guide apparatus according to claim 1, wherein the signal correction unit includes differentiating units which differentiate the detection signals that are output from the gap sensors, and the signal correction unit determines variation amounts of the detection signals on the basis of waveform variations of differential signals which are obtained by the differentiating units.

7. The magnetic guide apparatus according to claim 1, wherein the signal correction unit includes differentiating units which differentiate, at least by second-order differentiation, the detection signals that are output from the gap sensors, and the signal correction unit determines variation amounts of the detection signals on the basis of waveform variations of differential signals which are obtained by the differentiating units.

8. The magnetic guide apparatus according to claim 1, wherein the signal correction unit includes differentiating units which differentiate the detection signals that are output from the gap sensors, and holding units which hold differential signals that are obtained by the differentiating units, and the signal correction unit determines a variation amount of each of the detection signals on the basis of a difference signal between each differential signal which is held in the associated holding unit and is obtained a predetermined time before, and each differential signal obtained at a present time.

9. The magnetic guide apparatus according to claim 1, wherein a steady-state difference correction unit, which corrects a relative difference of the detection signal that is output from each of the gap sensors, is provided at a front stage of the signal correction unit, and each detection signal, which is corrected by the steady-state difference correction unit, is input to the signal correction unit.

10. The magnetic guide apparatus according to claim 9, wherein the steady-state difference correction unit finds a difference between the detection signals which are output from the gap sensors, multiplies a difference signal indicative of the difference by a predetermined gain, and feeds a resultant multiplied signal to each detection signal.

11. The magnetic guide apparatus according to claim 9, wherein the steady-state difference correction unit includes an averaging unit which generates an average value signal in which the detection signals that are output from the gap sensors are averaged, and the steady-state difference correction unit finds a difference between the average value signal, which is generated by the averaging unit, and each of the detection signals, multiplies a difference signal indicative of the difference by a predetermined gain, and feeds a resultant multiplied signal to each detection signal.

12. The magnetic guide apparatus according to claim 10, wherein the steady-state difference correction unit includes:

variation amount detection units which detect variation amounts of the detection signals which are output from the gap sensors; and a gain setting unit which sets a value of the gain, on the basis of a difference between the variation amounts of the detection signals, which are detected by the variation amount detection units.

13. The magnetic guide apparatus according to claim 12, wherein the gain setting unit sets the gain to be less than a predetermined value, in a case where the difference between the variation amounts of the detection signals is greater than a predetermined value.

* * * * *